US008867932B2

(12) United States Patent
Ukai et al.

(10) Patent No.: US 8,867,932 B2
(45) **Date of Patent: *Oct. 21, 2014**

(54) CARTRIDGE AND IMAGE FORMING APPARATUS

(71) Applicant: Brother Kogyo Kabushiki Kaisha, Nagoya (JP)

(72) Inventors: Masamitsu Ukai, Nagoya (JP); Yasuo Fukamachi, Nagoya (JP); Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/873,108

(22) Filed: Apr. 29, 2013

(65) Prior Publication Data

US 2013/0272724 A1 Oct. 17, 2013

Related U.S. Application Data

(63) Continuation of application No. 13/075,157, filed on Mar. 29, 2011, now Pat. No. 8,463,145.

(30) Foreign Application Priority Data

Mar. 31, 2010 (JP) ..... 2010-083408

(51) Int. Cl.

| | |
|---|---|
| ***G03G 15/00*** | (2006.01) |
| ***G03G 15/08*** | (2006.01) |
| ***G03G 21/18*** | (2006.01) |
| ***G03G 21/16*** | (2006.01) |

(52) U.S. Cl.

CPC ..... *G03G 21/16* (2013.01); *G03G 21/1896* (2013.01)

USPC ..... 399/12; 399/111; 399/119

(58) Field of Classification Search

USPC ..... 399/12, 110, 111, 119

See application file for complete search history.

(56) References Cited

U.S. PATENT DOCUMENTS

| | | | |
|---|---|---|---|
| 5,053,816 | A | 10/1991 | Takahashi |
| 7,418,214 | B2 | 8/2008 | Yoshida et al. |

(Continued)

FOREIGN PATENT DOCUMENTS

| | | | |
|---|---|---|---|
| CN | 201464807 | U | 5/2010 |
| JP | S63-118042 | U | 7/1988 |

(Continued)

OTHER PUBLICATIONS

Machine translation of JP 2006-235236 dated Jan. 9, 2014.*

(Continued)

*Primary Examiner* — Sophia S Chen

(74) *Attorney, Agent, or Firm* — Baker Botts L.L.P.

(57) ABSTRACT

A cartridge detachably attachable to an image forming apparatus which includes a main body, a driving unit and a detecting unit, includes: a housing that is configured to accommodate a developer therein, and includes a first side wall and a second side wall opposed to the first side wall in a longitudinal direction; a passive unit that is configured to receive a driving force from the driving unit, is mounted on the first side wall, and is rotatable around a first axis line parallel to the longitudinal direction; and a detected body mounted on the first side wall and including a detected part which is detected by the detecting unit. The detected body advances outwards in the longitudinal direction with respect to the first side wall and retracts inwards in the longitudinal direction with respect to the first side wall by the driving force received by the passive unit.

18 Claims, 32 Drawing Sheets

(56) References Cited

U.S. PATENT DOCUMENTS

| | | | | |
|---|---|---|---|---|
| 8,463,145 | B2 * | 6/2013 | Ukai et al. | 399/12 |
| 2003/0185579 | A1 | 10/2003 | Nishino et al. | |
| 2006/0193646 | A1 | 8/2006 | Suzuki et al. | |
| 2007/0059018 | A1 | 3/2007 | Tokuda | |
| 2007/0122165 | A1 | 5/2007 | Igarashi et al. | |
| 2007/0140709 | A1 | 6/2007 | Yoshida et al. | |

FOREIGN PATENT DOCUMENTS

| | | | |
|---|---|---|---|
| JP | H02-078949 | U | 6/1990 |
| JP | H02-262168 | A | 10/1990 |
| JP | H03-212656 | A | 9/1991 |
| JP | H04-031156 | U | 3/1992 |
| JP | H04-191773 | A | 7/1992 |
| JP | H04-112263 | U | 9/1992 |
| JP | H04-114057 | U | 10/1992 |
| JP | 2002-169449 | A | 6/2002 |
| JP | 2003-271039 | A | 9/2003 |
| JP | 2006-235236 | A | 9/2006 |
| JP | 2006-267994 | A | 10/2006 |
| JP | 2007-079284 | A | 3/2007 |
| JP | 2007-164095 | A | 6/2007 |
| JP | 2009-223017 | A | 10/2009 |

OTHER PUBLICATIONS

Japan Patent Office, Decision of Patent Grant for Japanese Patent Application No. 2010-083408 (counterpart to co-pending U.S. Appl. No. 13/075,157), dispatched Jan. 5, 2012.

Japan Patent Office, International Search Report for International Patent Application No. PCT/JP2011/057946 (counterpart to co-pending U.S. Appl. No. 13/075,157), mailed Apr. 26, 2011.

Korean Intellectual Property Office, Notice of Preliminary Rejection for Korean Patent Application No. 10-2012-7028457 (counterpart to above-captioned patent application), mailed Feb. 27, 2014.

* cited by examiner

CARTRIDGE AND IMAGE FORMING APPARATUS

This application is a continuation application of U.S. patent application Ser. No. 13/075,157, filed Mar. 29, 2011, which claims priority from Japanese Patent Application No. 2010-083408, which was filed on Mar. 31, 2010, the disclosures of which are incorporated herein by reference in their entirety.

BACKGROUND

The disclosure relates to a cartridge detachably attached to the main body of an image forming apparatus such as a laser printer, and to an image forming apparatus.

There is disclosed an image forming apparatus, such as a laser printer, of a type that a developing cartridge is attached to the main body of the apparatus as to be detachable therefrom (See Japanese Unexamined Patent Application Publication No. 2006-267994). The developing cartridge contains a developer. When the developing cartridge runs out of the developer, the cartridge is removed from the main body of the apparatus. Then, a new developing cartridge is attached to the main body. Furthermore, when the apparatus jams with sheets within the main body, the developing cartridge may be removed from the main body to eliminate such a jam, and then attached again to the main body.

In the image forming apparatus of this type, it is suggested how to determine whether the developing cartridge is a brand-new or used one when attached to the main body as a way to find out the wear of the developing cartridge.

On the side surface of such developing cartridge is a detecting gear mounted, and the detecting gear is rotatable around an axis line (rotation axis line) extending in a transverse direction crossing the side surface at a right angle. The detecting gear has an plate-shaped detecting gear body and an contact protrusion integrally formed with the detecting gear body on the outer side (the opposite surface to the side of the developing cartridge with respect to the detecting gear body) of the detecting gear body. The detecting gear body has gear teeth on its circumferential surface (except some portion of the circumferential surface).

Further, a transmission gear is provided on the side surface of the developing cartridge, and the transmission gear is rotatable around an axis line extending parallel to the axis line of the detecting gear at a distance. The transmission gear rotates as a whole with an agitator for agitating the developer contained in the developing cartridge. The transmission gear has gear teeth on its entire circumferential surface.

In a new developing cartridge, the gear teeth of the transmission gear are engaged with the gear teeth of the detecting gear. When the developing cartridge is attached to the main body, the driving force of a motor is delivered to the transmission gear, and further transmitted from the transmission gear to the detecting gear through those gear teeth.

This allows the detecting gear to rotate, and the contact protrusion to move in the rotational direction of the detecting gear in response to the rotation of the detecting gear. When the toothless portion of the detecting gear faces the gear teeth of the transmission gear, the gear teeth of the transmission gear is disengaged with the gear teeth of the detecting gear, and the rotation of the detecting gear stops. Thus, if the developing cartridge is ever attached to the main body, the gear teeth of the transmission gear is disengaged with the gear teeth of the detecting gear, and such position remains afterwards.

In the main body is a sensor mounted for detecting the penetration of the contact protrusion, given that the contact protrusion is a detected part. Then, based on the detection result as to the penetration of the contact protrusion by the sensor, an old or new developing cartridge is determined. In other words, after an developing cartridge is attached to the main body, the developing cartridge is determined new if the sensor detects the penetration of the contact protrusion. On the other hands, after an developing cartridge is attached to the main body, the developing cartridge is determined old if the sensor does not detect the penetration of the contact protrusion.

SUMMARY

However, the contact protrusion may touch or catch other members in the main body of the apparatus when the developing cartridge is attached to, or removed from, the main body, because the contact protrusion is mounted to project outwards from the side of the developing cartridge. Moreover, if the developing cartridge is removed from the main body of the apparatus, the contact protrusion may be damaged by, for example, a collision with other members when the developing cartridge is manipulated by end users.

The aspect of the embodiment is to provide a cartridge for preventing the hindrance of the detected part to the installation or removal of the cartridge within the main body of the apparatus.

The aspect of the embodiment is further to provide a cartridge for preventing the damage of the detected part by, for example, a collision with other members when the cartridge is removed from the main body of the apparatus.

The aspect of the embodiment provides the following arrangements.

(1) A cartridge detachably attachable to an image forming apparatus which includes a main body, a driving unit provided in the main body and a detecting unit provided in the main body, the cartridge comprising:

a housing that is configured to accommodate a developer therein, and includes a first side wall and a second side wall opposed to the first side wall in a longitudinal direction;

a passive unit that is configured to receive a driving force from the driving unit, is mounted on the first side wall, and is rotatable around a first axis line parallel to the longitudinal direction; and a detected body mounted on the first side wall and including a detected part which is detected by the detecting unit, wherein the detected body advances outwards in the longitudinal direction with respect to the first side wall and retracts inwards in the longitudinal direction with respect to the first side wall by the driving force received by the passive unit.

(2) The cartridge according to (1) further comprising an agitator configured to agitate the developer contained in the housing, wherein the agitator is supported on the first and second side walls so as to be rotatable around a second axis line extending parallel to the first axis line, and is rotated by the driving force received by the passive unit, wherein the detected body is oscillateable in a moving direction parallel to the first axis line, and wherein, the detected body is movable from a first position where a distance in the moving direction between the detected body and the first side wall is a first distance, via a second position where the distance in the moving direction between the detected body and the first side wall is a second distance larger than the first distance, to a third position where the distance in the moving direction between the detected body and the first side wall is a third distance smaller than the second distance.

(3) The cartridge according to (2), wherein the first distance is the same as the third distance.

(4) The cartridge according to (2) or (3), wherein the detected body is rotatably mounted around a third axis line extending parallel to the first axis line, and is movable from the first position, via the second position, to the third position, by the rotation in a first direction, wherein the first side wall includes a sliding part on which a contact part of the detected body slides as the detected body moves from the first position to the third position, and wherein one of the contact part and the sliding part includes an inclined surface so tilted as to be more apart from the first side wall as the inclined surface goes downstream in the first direction.

(5) The cartridge according to (4), wherein the one of the contact part and the sliding part, including the inclined surface, includes a parallel surface extending continuously from the inclined surface downstream in the first direction and running parallel to the first side wall.

(6) The cartridge according to (4) or (5) further comprising a transmission gear configured to transmit the driving force received by the passive unit to the detected body, wherein the detected body includes a circumferential surface around the third axis line, wherein a toothless portion is formed on a part of the circumferential surface, and gear teeth is formed on the remaining portion other than the toothless portion of the circumferential surface, and wherein the gear teeth are engaged with the transmission gear while the detected body moves from the first position to the third position.

(7) The cartridge according to (4), (5) or (6) further comprising a pressing member configured to press the detected body to the first side wall.

(8) The cartridge according to further comprising a boss projecting from the first side wall in the moving direction, wherein the pressing member includes a wire spring coiled around the boss and having one end contact with a side of the detected body opposite to the first side wall.

(9) The cartridge according to (8), wherein the detected body includes a pressed surface with which the one end of the wire spring is in contact in the first direction when the detected body is in the third position.

(10) The cartridge according to (7), wherein the first side wall includes a side wall main body and a cover attached to an outer side of the side wall main body in the longitudinal direction to cover the detected body; and the pressing member includes a coil spring interposed between the detected body and the cover and contacting the detected body.

(11) The cartridge according to (2) or (3), further comprising a rotational body provided on the first side wall so as to be rotatable around a third axis line extending parallel to the first axis line, wherein the rotational body is rotated in a second direction by the driving force received by the passive unit, wherein the detected body is provided so as to be oscillateable in a moving direction parallel to the first axis line, and to maintain the position of the detected body around the third axis line, wherein the rotational body includes an inclined surface on which a contact part of the detected body slides while the detected body moves from the first position to the third position, and wherein the inclined surface is tilted so as to be more apart from the first side wall as the inclined surface goes upstream in the second direction.

(12) The cartridge according to (11), wherein the rotational body includes a parallel surface extending continuously from the inclined surface upstream in the second direction and running parallel to the first side wall.

(13) The cartridge according to (11) or (12) further comprising a transmission gear configured to transmit the driving force received by the passive unit to the rotational body;

wherein a toothless portion is formed on a portion of a circumferential surface around the third axis line, and gear teeth is formed on the remaining portion other than the toothless portion of the circumferential surface, and wherein the gear teeth are engaged with the transmission gear while the detected body moves from the first position to the third position.

(14) The cartridge according to (11), (12), or (13) further comprising a pressing member configured to press the detected body against the first side wall.

(15) The cartridge according to (14), further comprising a boss projecting from the first side wall in the moving direction, wherein the pressing member includes a wire spring coiled around the boss and having one end contact a side of the detected body opposite to the first side wall.

(16) The cartridge according to (14), wherein the first side wall includes a side wall main body and a cover so attached to an outer side of the side wall main body in the longitudinal direction to cover the detected body; and wherein the pressing member includes a coil spring interposed between the detected body and the cover and contacting the detected body.

(17) The cartridge according to one of (2) to (16), wherein the first side wall includes a side wall main body and a cover so attached to an outer side of the side wall main body in the longitudinal direction so as to cover the detected body, and wherein the detected body is arranged within the cover when the detected body is in the first and third positions, and the detected body is exposed from the cover when the detected body is in the second position.

(18) The cartridge according to one of (1) to (17) further comprising a developing roller provided between the first and the second side walls so as to be rotatable around a fourth axis line extending parallel to the first axis line at a distance, and to be rotated by the driving force received by the passive unit.

(19) An image forming apparatus comprising:

a main body;

a driving unit provided in the main body;

a detecting unit provided in the main body; and a cartridge detachably attached to the main body, the cartridge including:

a housing that is configured to accommodate a developer therein, and includes a first side wall and a second side wall opposed to the first side wall in a longitudinal direction;

a passive unit that is configured to receive a driving force from the driving unit, is mounted on the first side wall, and is rotatable around a first axis line parallel to the longitudinal direction; and a detected body mounted on the first side wall and including a detected which is detected by the detecting unit, wherein the detected body advances outwards in the longitudinal direction with respect to the first side wall and retracts inwards in the longitudinal direction with respect to the first side wall by the driving force received by the passive unit.

DESCRIPTION OF PREFERRED EXEMPLARY EMBODIMENTS

In the followings, exemplary embodiments will be specifically described with reference to the accompanying drawings.

1. General Configuration of Laser Printer

Figure 1:
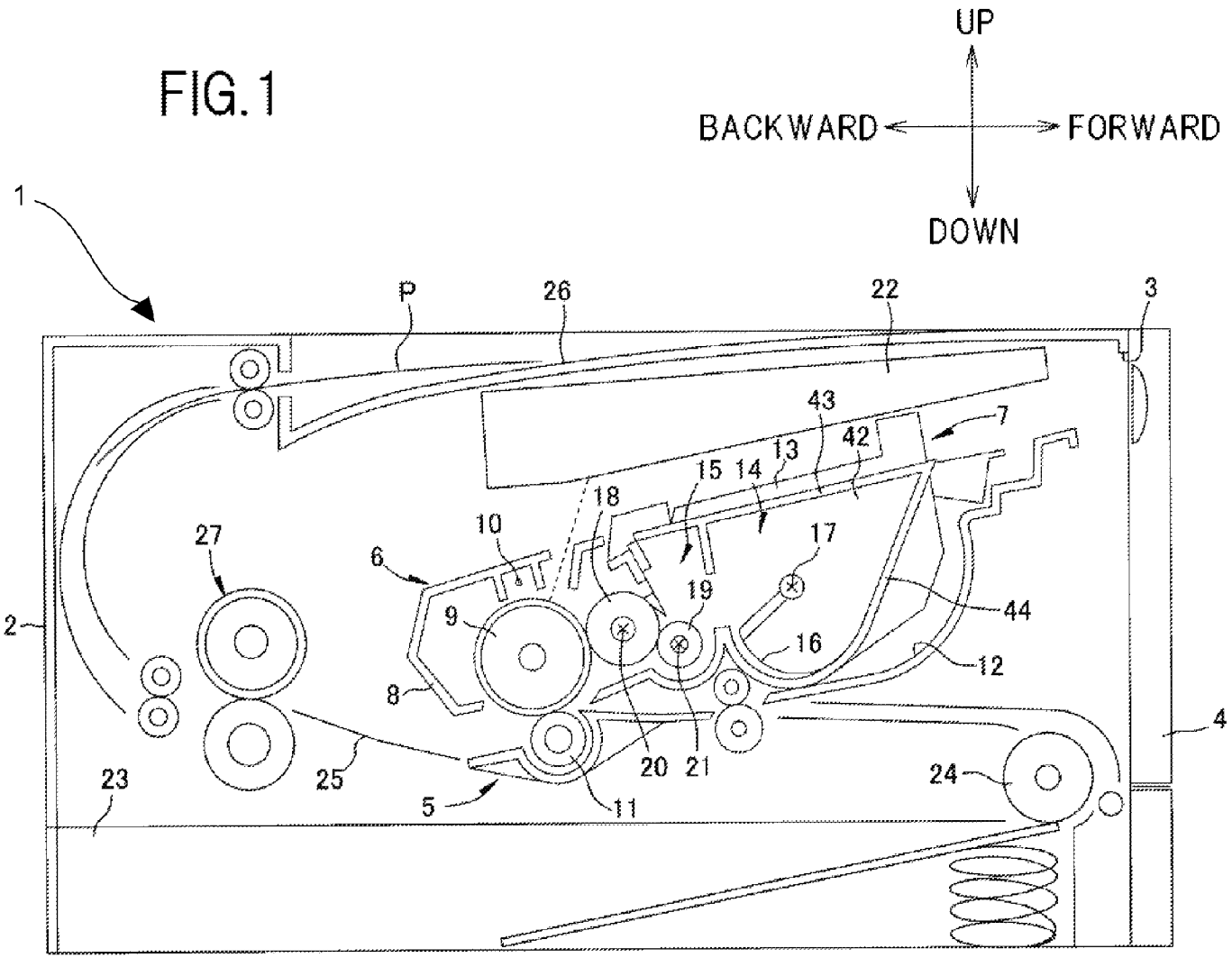
FIG. 1 is a section view of a laser printer mounting an developing cartridge according to an embodiment.

As shown in FIG. 1, a laser printer 1, which is one embodiment of an image forming apparatus, includes a body casing 2 as one embodiment of a body of the apparatus. The body casing 2 has, on its one side wall, an opening 3 for accommodating a cartridge, and a front cover 4 for opening or closing the opening 3.

Meanwhile, to clarify the description below, the side of the casing 2 on which the front cover 4 is fitted is referred to as the front side of the laser printer 1. The geometry (i.e., left, right, up and down) of the laser printer 1 is set from the vantage point looking at the front side of the laser printer 1. Further, the forward or backward direction of a developing cartridge 7, which is explained below, is determined with respect to the body casing 2 mounting the cartridge 7, and the other directions (i.e. left, right, up and down) of the developing cartridge 7 is set front the vantage point looking at its front side.

The body casing 2 includes, in its center portion, a developing unit 5 mounted closer to the front side of the laser printer 1. The developing unit 5 may be mounted to, or removed from, the body casing 2 through the opening 3 when the front cover 4 is opened up.

The developing unit 5 includes a drum cartridge 6 and the developing cartridge 7 as an embodiment of a cartridge detachably mounted on the drum cartridge 6.

The drum cartridge 6 includes a drum frame 8. The drum frame 8 includes a photosensitive drum 9 rotatably supported in the rear end portion of the frame 8. An electric charger 10 and a transcription roller 11 are also supported within the drum frame 8. The electric charger 10 and the transcription roller 11 are arranged in front of and below the photosensitive drum 9, respectively.

The forward portion of the drum frame 8 ahead of the photosensitive drum 9 is formed as a developing cartridge mounting portion 12, in which the developing cartridge 7 is mounted.

The developing cartridge 7 includes a housing 13 for accommodating a developer. The housing 13 includes therein a developer accommodating room 14 and a developing room 15 adjacently behind the developer accommodating room 14. Both rooms 14 and 15 are in communication.

The developer accommodating room 14 includes an agitator 16 rotatably supported with respect to a agitator rotation axis line 17 as an embodiment of the second axis line extending from the left to the right of the laser printer 1. The rotation of the agitator 16 makes the developer in the developer accommodating room 14 to be agitated, and then delivered from the developer accommodating room 14 to the developing room 15.

The developing room 15 includes a developing roller 18 and a feed roller 19 rotatably supported with respect to a developing rotation axis line 20 and a feed rotation axis line 21, respectively, which are embodiments of the fourth axis lines extending from the left to the right of the laser printer 1. The developing roller 18 is arranged in such a way that the rear end portion of the housing 13 exposes a portion of the circumferential surface of the developing roller 18. The developing cartridge 7 is mounted in the drum cartridge 6 in a manner that the circumferential surfaces of the developing roller 18 and the photosensitive drum 9 are in contact. The feed roller 19 is arranged at the lower front of the developing roller 18 in a manner that its circumferential surface is in contact with the circumferential surface of the developing roller 18. The feed roller 19 feeds the developer in the developing room 15 onto the circumferential surface of the developing roller 18, which then bears the developer as a thin layer.

Further, the body casing 2 contains an exposure unit 22, which includes (without limitation) laser, above the developing unit 5.

When an image is formed, the photosensitive drum 9 rotates clockwise at a constant rate in FIG. 1. While rotating, the circumferential surface of the photosensitive drum 9 becomes charged uniformly with electricity by discharging of the electric charger 10. Meanwhile, the exposure unit 22 radiates a laser beam based on the image data received from a personal computer (not shown) connected to the laser printer 1. The laser beam passes through between the electric charger 10 and the developing cartridge 7, and irradiates, and thereby exposes selectively, the circumferential surface of the photosensitive drum 9, which has been uniformly positive-charged. This makes electric charges selectively removed from the exposed portion of the circumferential surface of the photosensitive drum 9, and develops an electrostatic latent image on the circumferential surface of the photosensitive drum 9. When the photosensitive drum 9 so rotates as to make the electrostatic latent image face the developing roller 18, the developer is fed from the developing roller 18 onto the electrostatic latent image. The developer image is formed this way onto the circumferential surface of the photosensitive drum 9.

A sheet supply cassette 23 is arranged, at the bottom of the body casing 2, to supply sheets S. A pick-up roller 24 is provided, above the sheet supply cassette 23, to draw sheets out from the sheet supply cassette 23.

Further, a conveying path 25, which is in "S" shape from the side of the laser printer 1, is formed within the body casing 2. The conveying path 25 starts at the sheet supply cassette 23, passes through between the photosensitive drum 9 and the transcription roller 11, and reaches a sheet discharge tray 26 which is formed on the top surface of the body casing 2.

The developer image onto the circumferential surface of the photosensitive drum 9 is electrically attracted, and thereby transcribed, onto a sheet S when the photosensitive drum 9 so rotates as to make the developer image face the sheet S passing through the photosensitive drum 9 and the transcription roller 11.

A photographic fixing unit 27 is provided downstream of the conveying path 25 from the transcription roller 11 in the direction of conveying the sheet S. The sheet S on which the developer image has been transcribed passes through the photographic fixing unit 27 while being conveyed through the conveying path 25. The heat and pressure of the photographic fixing unit 27 fixes the developer image on the sheet P as an image. The sheet P bearing the image this way is further conveyed though the conveying path 25, and discharged on the sheet discharge tray 26.

2. Developing Cartridge

(1) Housing

As illustrated in FIG. 1, the housing 13 of the developing cartridge 7 is formed as a box having its back side open. Specifically, the housing 13 includes a first side wall 41 (see FIG. 3) and a second side wall 42. The first and second side walls 41 and 42 are configured as plates facing each other in the right-to-deft direction, and respectively extending in the front-to-back direction. Further, the hosing 13 includes a upper side wall 43 built between the upper edges of the first and second side walls 41 and 42, and a lower side wall 44 built between the lower edges of the first and second side walls 41 and 42. The front end portion of the lower side wall 44 extends upward in a curve, and is affixed to the front end portion of the upper side wall 43.

(2) Gear Train

On the left in FIGS. 3 to 6, the outer side (left side) of the first side wall 41 is provided with, (a) an input gear 45, a developing gear 46, a feed gear 47, and an intermediate gear 48, all as an embodiment of a passive unit; (b) a transmitting rotational body of an agitator gear 49, all as an embodiment of a transmission gear; and (c) as an embodiment of a body to be detected, a detected rotational body 50.

(2-1) Input Gear

The input gear 45 is arranged on the upper portion of the rear end of the first side wall 41. The input gear 45 is rotatably supported with respect to a center axis line 511 (see FIG. 3), which is an embodiment of the first axis line of the input gear rotation axis 51 (See FIG. 4) extending in the right-to-left direction. The input gear rotation axis 51 is unrotatably supported on the first side wall 41.

Figure 3:
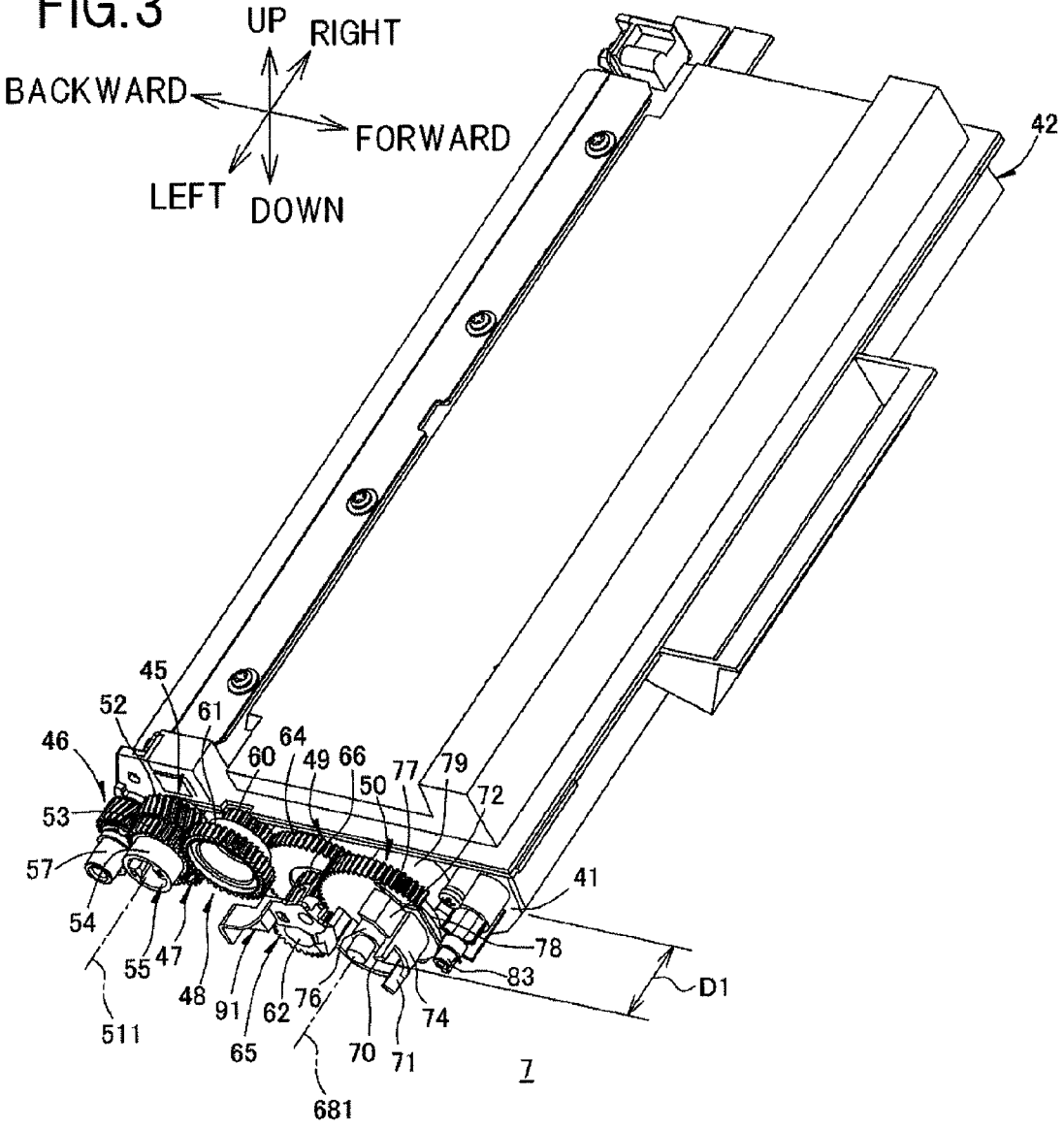
FIG. 3 is a schematic view of the developing cartridge from the vantage point of the left-front-top of the cartridge, without the gear cover.

Further, as illustrated in FIG. 3, the input gear 45 includes, in an integral body, a larger diameter gear part 52, a smaller diameter gear part 53 and a coupling part 54. The larger diameter gear part 52, the smaller diameter gear part 53, and the coupling part 54 are arranged in this order from the side of the first side wall 41.

The larger diameter gear part 52 has a circular-plate shape coaxially arranged with the input gear rotation axis 51. The larger diameter gear part 52 includes gear teeth (e.g., helical gear teeth) around the entire circumferential surface thereof.

The smaller diameter gear part 53 has a circular-plate shape coaxially arranged with the input gear rotation axis 51, and has a diameter smaller than the larger diameter gear part 52. The smaller diameter gear part 53 includes gear teeth (e.g., inclined teeth) around the entire circumferential surface thereof.

The coupling part 54 has the shape of a cylindrical column coaxially arranged with the input gear rotation axis 51, and includes a circumferential surface of a diameter smaller than that of the smaller diameter gear part 53. The coupling part 54 includes a coupling recess 55 on its left side. When the developing cartridge 7 is mounted in the body casing 2, the front end portion of a driving unit 56 (See FIG. 2) provided within the body casing 2 is inserted into the coupling recess 55.

The driving unit 56 is provided movably in the left or right direction. When the developing cartridge 7 is mounted in the body casing 2, the driving unit 56 inserts its front end portion into the coupling recess 55 along the center axis line 511 as the unit 56 moves to the right. This so connects the driving unit 56 to the coupling recess 55 as not to allow one of them to rotate relatively with respect to the other. Therefore, when operated, the driving unit 56 deliver its rotational force to the input gear 45 as a driving force, and allows the input gear 45 to rotate with the driving unit 56.

(2-2) Developing Gear

Figure 4:
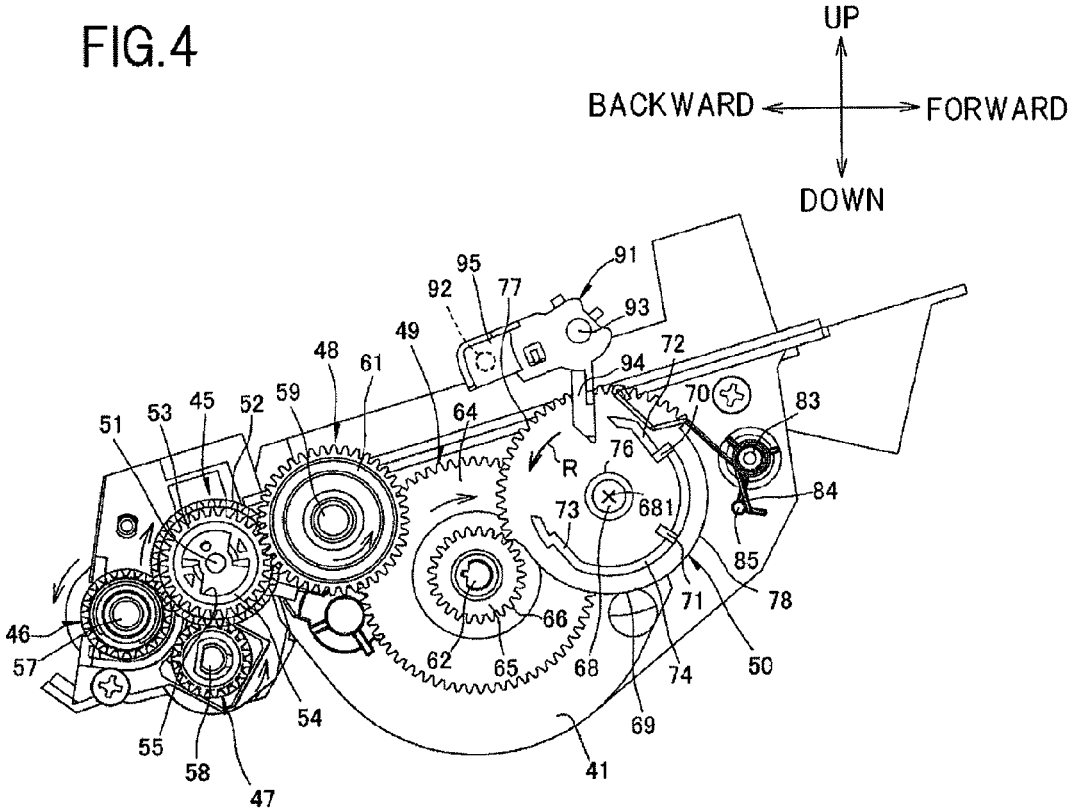
FIG. 4 is a left side view of the developing cartridge without the gear cover.

The developing gear 46 is arranged, as shown in FIG. 4, back below the input gear 45. The developing gear 46 is attached to a developing roller axis 57, which belongs to the developing roller 18, so as not to be relatively rotatable with respect to the axis 57. The developing roller axis 57 is arranged rotatably with respect to the first side wall 41, and has a center axis line playing a role as the developing rotation axis line 20 which is the rotation axis line of the developing roller 18 (See FIG. 1). Gear teeth are formed on the whole circumferential surface of the developing gear 46, and are engaged with the gear teeth of the larger diameter gear part 52 of the input gear 45.

(2-3) Feed Gear

The feed gear 47 is arranged below the input gear 45 as illustrated in FIG. 4. The feed gear 47 is attached to a feed roller axis 58, which belongs to the feed roller 19 (See FIG. 1), so as not to be relatively rotatable with respect to the axis 58. The feed roller axis 58 is arranged rotatably with respect to the first side wall 41, and has a center axis line playing a role as the feed rotation axis line 21 which is the rotation axis line of the feed roller 19 (See FIG. 1). Gear teeth are formed on the whole circumferential surface of the feed gear 47, and are engaged with the gear teeth of the larger diameter gear part 52 of the input gear 45.

(2-4) Intermediate Gear

The intermediate gear 48 is arranged front above the input gear 45 as illustrated in FIG. 4. The intermediate gear 48 is attached rotatably with respect to the center axis line of a intermediate gear rotation axis 59 extending in the right-to-left direction. The intermediate gear rotation axis 59 is supported unrotatably on the first side wall 41.

Moreover, as illustrated in FIG. 3, the intermediate gear 48 includes, as an integral body, a smaller diameter part 60 having a circular-plate shape of relatively a small outer diameter, and a larger diameter part 61 having a cylindrical shape of relatively a large outer diameter. The smaller and larger diameter parts 60 and 61 are arranged in this order from the first side wall 41. Each center axis line of the smaller and larger diameter parts 60 and 61 is consistent with the center axis line of the intermediate gear rotation axis 59.

The smaller diameter part 60 includes gear teeth formed around its entire circumferential surface.

The larger diameter part 61 includes gear teeth formed around its entire circumferential surface. The gear teeth of the larger diameter part 61 are engaged with those of the smaller diameter gear part 53 of the input gear 45.

(2-5) Agitator Gear

The agitator gear 49 is arranged front below the intermediate gear 48 as illustrated in FIG. 4. The agitator gear 49 is attached to an agitator rotation axis 62 so as not to be relatively rotatable with respect to the agitator rotation axis 62. The agitator rotation axis 62 passes through the first and second side walls 41 and 42 (See FIG. 1) in the right-to-left direction, and is supported rotatably in the first and second side walls 41 and 42. The agitator 16 is attached to the agitator rotation axis 62 in the housing 13. In this manner, the agitator 16 and the agitator gear 49 may rotate integrally with the agitator rotation axis 62 with respect to the center axis line of the agitator rotation axis 62, which corresponds to the agitator rotation axis line 17 (See, FIG. 1).

Further, the agitator gear 49 includes a larger gear part 64 and a smaller gear part 65 as an integral body.

The larger gear part 64 is in circular-plate shape having a center axis line consistent to that of the agitator rotation axis 62. The larger gear part 64 includes gear teeth formed on the entire circumferential surface thereof. The gear teeth of the larger gear part 64 are engaged with the gear teeth of the smaller diameter part 60 of the intermediate gear 48.

The smaller gear part 65 is made, on the side of the larger gear part 64 opposite to the first side wall 41, in a circular plate shape having a diameter smaller than the larger gear part 64. The smaller gear part 65 includes gear teeth 66 formed on the entire circumferential surface thereof.

(2-6) Detected Rotational Body

The detected rotational body 50 is arranged front above the agitator gear 49 as illustrated in FIG. 4. The detected rotational body 50 is provided, as shown in FIGS. 3 and 4, rotatably with respect to a center axis line 681, which is an embodiment of the third axis line of a rotation axis 68 extending in the right-to-left direction. The rotation axis 68 is unrotatably supported on the first side wall 41.

Figure 5:
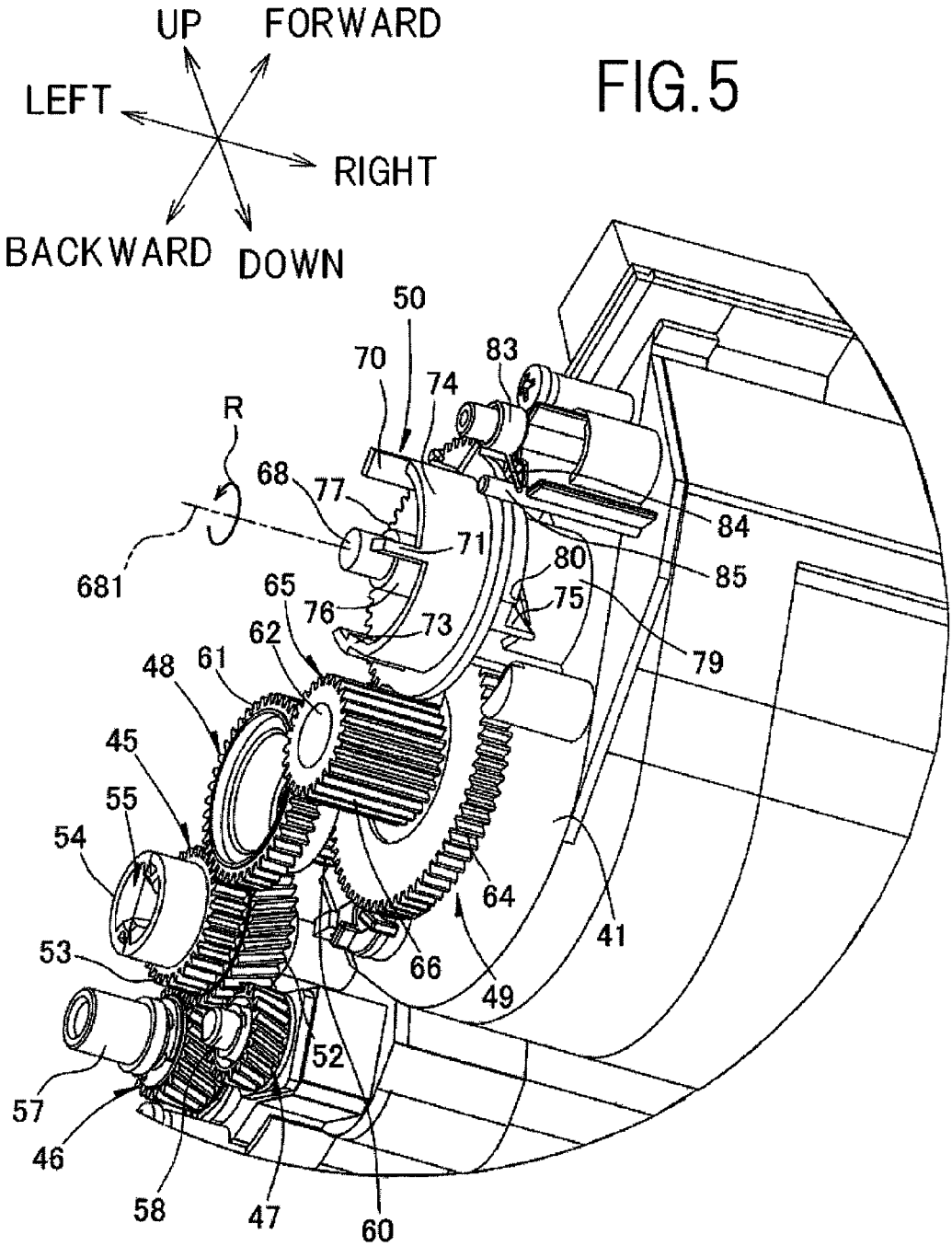
FIG. 5 is a schematic view of the developing cartridge from the vantage point of the left-front-bottom of the cartridge, without the gear cover.

Further, the detected rotational body 50 includes, as an integral body, a toothless gear part 69, a first detected part 70, a second detected part 71, a first pressed part 72, a second pressed part 73 (as an embodiment of a pressed surface), a connecting part 74, and a supporting part 75 (as an embodiment of a contact part) (See FIG. 5).

The toothless gear part 69 is configured in a circular plate shape coaxial with the center axis line 681 of the rotation axis 68. The left end surface (outer surface) of the toothless gear part 69 includes a cylindrical insert-penetrating boss 76 projecting therefrom. The rotation axis 68 is inserted into, and passes through, the cylindrical insert-penetrating boss 76 so as to be relatively rotatable and movable in the right-to-left direction.

The toothless gear part 69 includes gear tooth 77 (operating part) formed on a portion of the circumferential surface of the toothless gear part 69. Specifically, the toothless gear part 69 includes the toothless portion 78 (non-operating part) having a central angle of about 225 degrees around the circumferential surface of the gear part 69, and includes gear teeth 77 formed on the remaining portion (other than the toothless portion 78) of the circumferential surface, which amounts to a central angle of about 105 degrees. The gear teeth 77 engages with the smaller diameter gear part 65 of the agitator gear 49 in response to the rotational position of the detected rotational body 50. Moreover, the width (measure in the right-to-left direction) of the toothless gear part 69 is less than the measure in the right-to-left direction of the smaller diameter gear part 65 of the agitator gear 49. Both measures are so designed that, when the gear teeth 65 and 77 are in engagement, the movement of the toothless gear part 69 in the right-to-left direction does not release such engagement.

The first and second detected parts 70 and 71, the first and second pressed parts 72 and 73, and the connecting par 74 project from the left side surface of the toothless gear part 69.

The first detected part 70 is arranged on the line connecting the center axis line 681 of the rotation axis 68 and the gear tooth 77 located uppermost in a rotational direction R (clockwise in FIG. 4) (as an embodiment of the first direction) of the detected rotational body 50. The first detected part 70 is in the shape of a rectangular plate extending both in the right-to-left direction and in the direction of the diameter of the toothless gear part 69.

The second detected part 71 is located upstream from the first detected part 70 in the rotational direction R of the detected rotational body 50 on a circular arc passing the first detected part 70 around the center axis line 681, specifically at the position where the line connecting the second detected part 71 and the center axis line 681 forms the angle of about 80 degrees with the line connecting the first detected part 70 and the center axis line 681. The second detected part 71 is in the shape of a rectangular plate extending both in the right-to-left direction and in the direction of the diameter of the toothless gear part 69, and has the same measure as the first detected part 70 in the right-to-left direction.

The first pressed part 72, as viewed from the side surface, extends from the first detected part 70 in a straight line toward the downstream of the rotational direction R of the detected rotational body 50. The front end portion of the first pressed part 72 is obliquely bent in shape toward the center axis line 681 from the straight portion of the first pressed part 72.

The second pressed part 73 is located with a rotational symmetry of 180 degrees with respect to the first pressed part 72 around the center axis line 681. The second pressed part 73, as viewed from the side surface, has a straight portion extending parallel to the straight portion of the first pressed part 72.

The connecting part 74 is formed as a rib along a circular arc passing the first and second detected parts 70 and 71 around the center axis line 681, connects the first and second detected parts 70 and 71, and connects the second detected part 71 and the second pressed part 73.

The supporting part 75 projects from the right side surface (inner surface) of the toothless gear part 69 as illustrated in FIG. 5. The supporting part 75 is in the shape of a rectangular plate extending both in the right-to-left direction and in the direction of the diameter of the toothless gear part 69.

(3) Sliding Part

Figure 6:
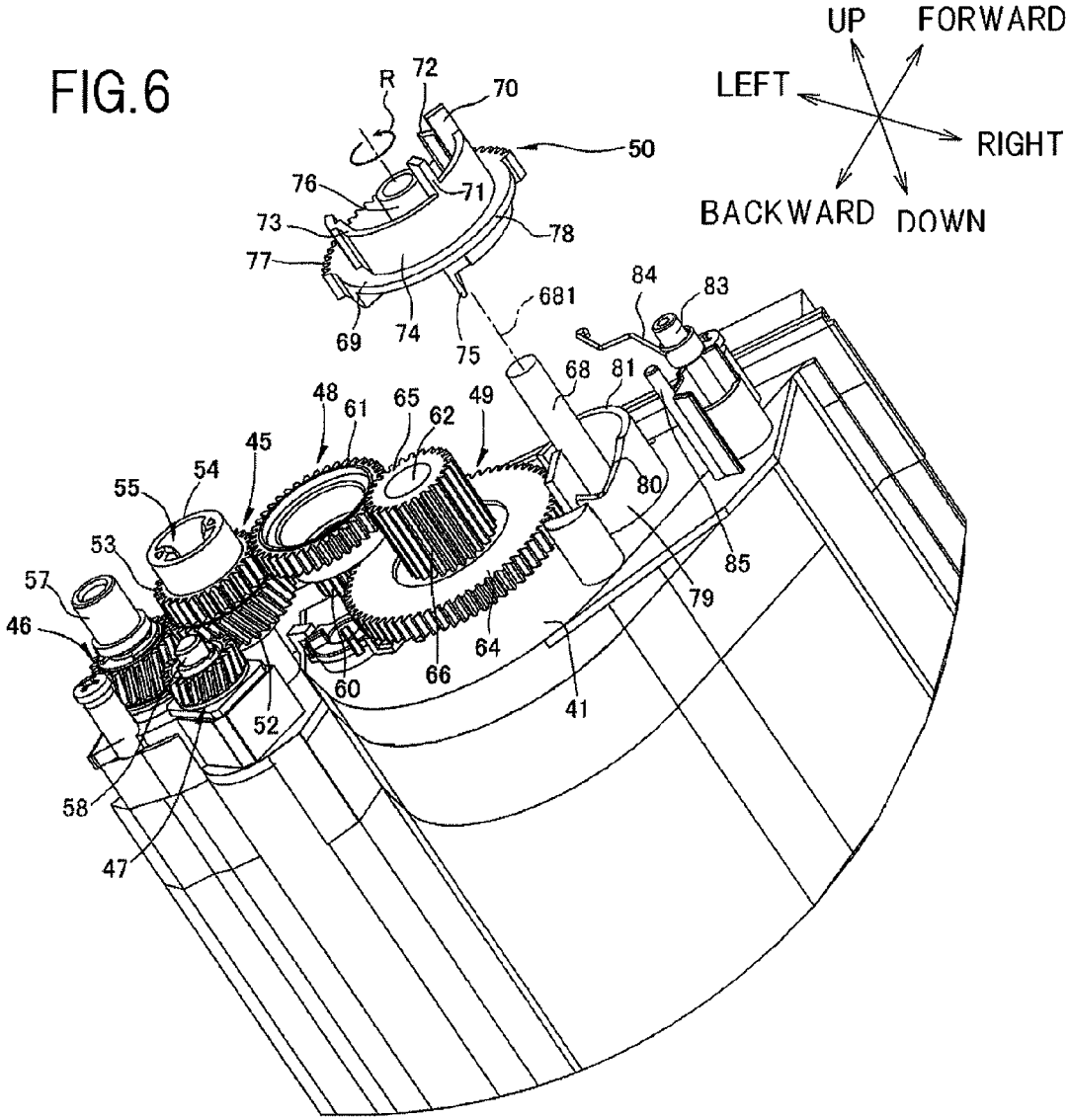
FIG. 6 is an exploded schematic view of the developing cartridge with the detected rotational body removed from the developing cartridge as shown in FIG. 5.

On the outer surface of the first side wall 41, as shown in FIG. 5, is a sliding part 79 formed between the first side wall 41 and the detected rotational body 50. As illustrated in FIG. 6, the sliding part 79 projects from the first side wall 41, and, as viewed from the side surface, has the three quarter cylindrical shape of a rib around the rotation axis 68.

Further, the height of the sliding part 79 from the first side wall 41 is the smallest at a portion below the rotation axis 68, increases gradually from that portion to a portion ahead of the rotation axis 68, and remains constant over the remainder of the sliding part 79. Therefore, over the portion where the height gradually increases, the left end surface of the sliding part 79 includes an inclined surface 80 so tilted as to be more apart from the first side wall 41 as it goes downstream of the rotational direction R of the detected rotational body 50. The left end surface of the sliding part 79 includes, downstream from the inclined surface 80 in the rotational direction R, a parallel surface 81 running parallel to the first side wall 41.

The sliding part 79 includes a notch portion 82 formed in a rectangular shape cut toward the first side wall 41 from the end portion of the parallel surface 81 downstream in the rotational direction R.

(4) Wire Spring

As illustrated in FIGS. 3 to 6, a boss 83 having the shape of a cylindrical column projects from the outer surface of the first side wall 41 in the forward direction of the detected rotational body 50. Around the boss 83 is a wire spring 84 coiled as an embodiment of a press member. An end portion of the wire spring 84 extends toward the outer side of the toothless gear part 69 of the detected rotational body 50. The middle part of that end portion is bent in a cranked shape, and the from end part of the end portion is in contact with the left side surface of the toothless gear part 69. A cylindrical boss 85 also projects from the outer surface of the first side wall 41 front below the boss 83. The other end of the wire spring 84 is coupled with the front side of the boss 85.

(5) Gear Cover

Figure 2:
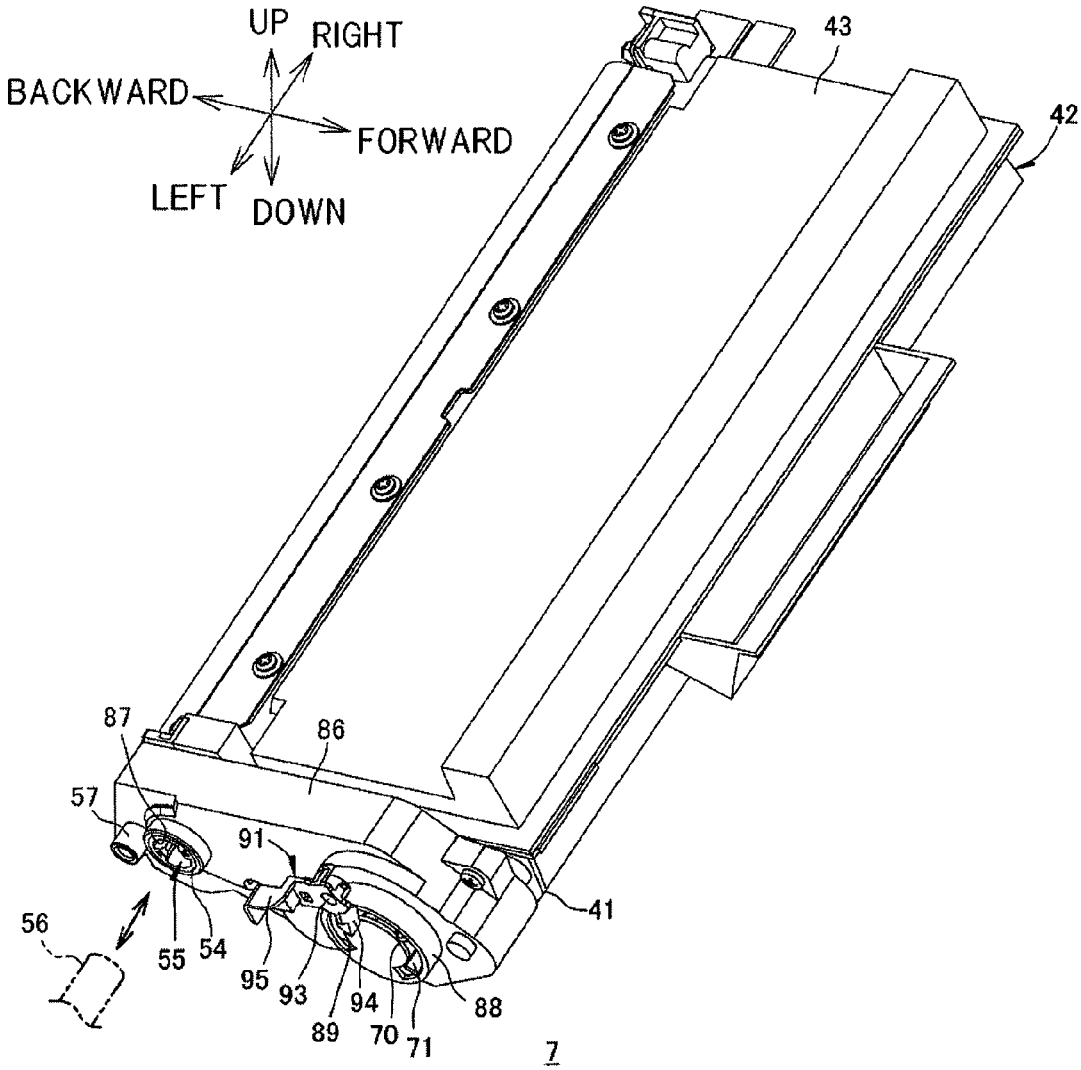
FIG. 2 is a schematic view of the developing cartridge from the vantage point of the left-front-top of the cartridge.

Moreover, as illustrated in FIG. 2, a gear cover 86 is attached to the outer side of the first side wall 41 as an embodiment of a cover. The gear cover 86 covers all together the input gear 45, the feed gear 47, the intermediate gear 48, and the agitator gear 49, the detected rotational body 50, and the wire spring 84. On the gear cover 86 is an opening 87 formed for exposing the coupling part 54 of the input gear 45. A circular-shaped protrusion 88 is also formed on the gear cover 86, as viewed from the side of the gear cover 86 accommodating the detected rotational body 50 therein. As viewed from the side exposing the first and second detected parts 70 and 71 in the left direction, a C-shaped opening 89 is formed on the left side surface of the protrusion 88, opposite the first and second detected parts 70 and 71 of the detected rotational body 50.

3. Detecting Device

The body casing 2 is provided therein with a detecting device for tracking the first and second detected parts 70 and 71, as illustrated in FIG. 4. The detecting device includes an actuator 91 and a light sensor 92 as an embodiment of a measuring unit.

The actuator 91 includes a swinging axis 93 extending in the right-to-left direction, a contact lever 94 extending downward from the swinging axis 93, and a light shielding lever 95 extending backward from the swinging axis 93, as an integral body. The swinging axis 93 is rotatably supported, for example, in an inner wall (not shown) of the body casing 2. The contact lever 94 and the light shielding lever 95 forms an angle of about 80 degrees around the swinging axis 93.

Figure 7A:
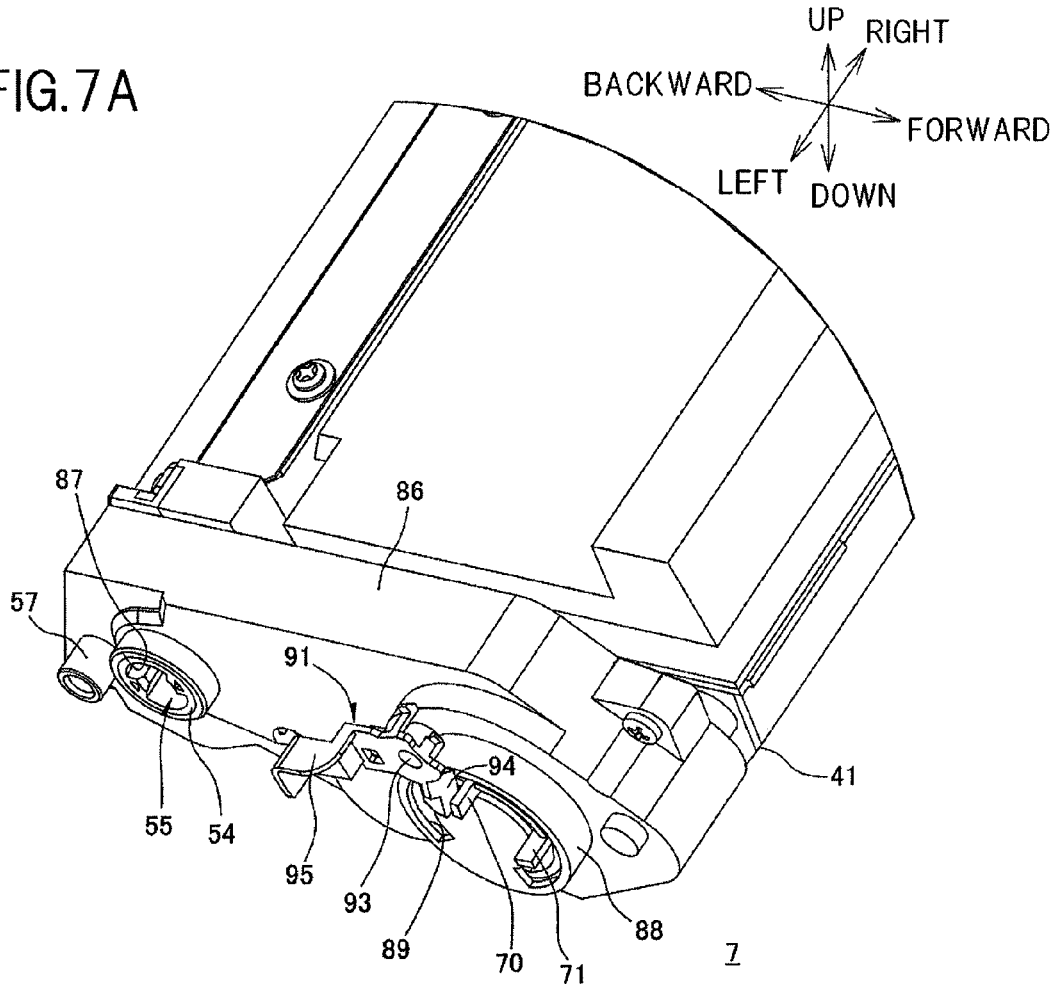
FIG. 7A is a schematic view of the developing cartridge front the vantage point of the left-front-top of the cartridge, with the detected rotational body rotated substantially from the position shown in FIG. 2.
Figure 7B:
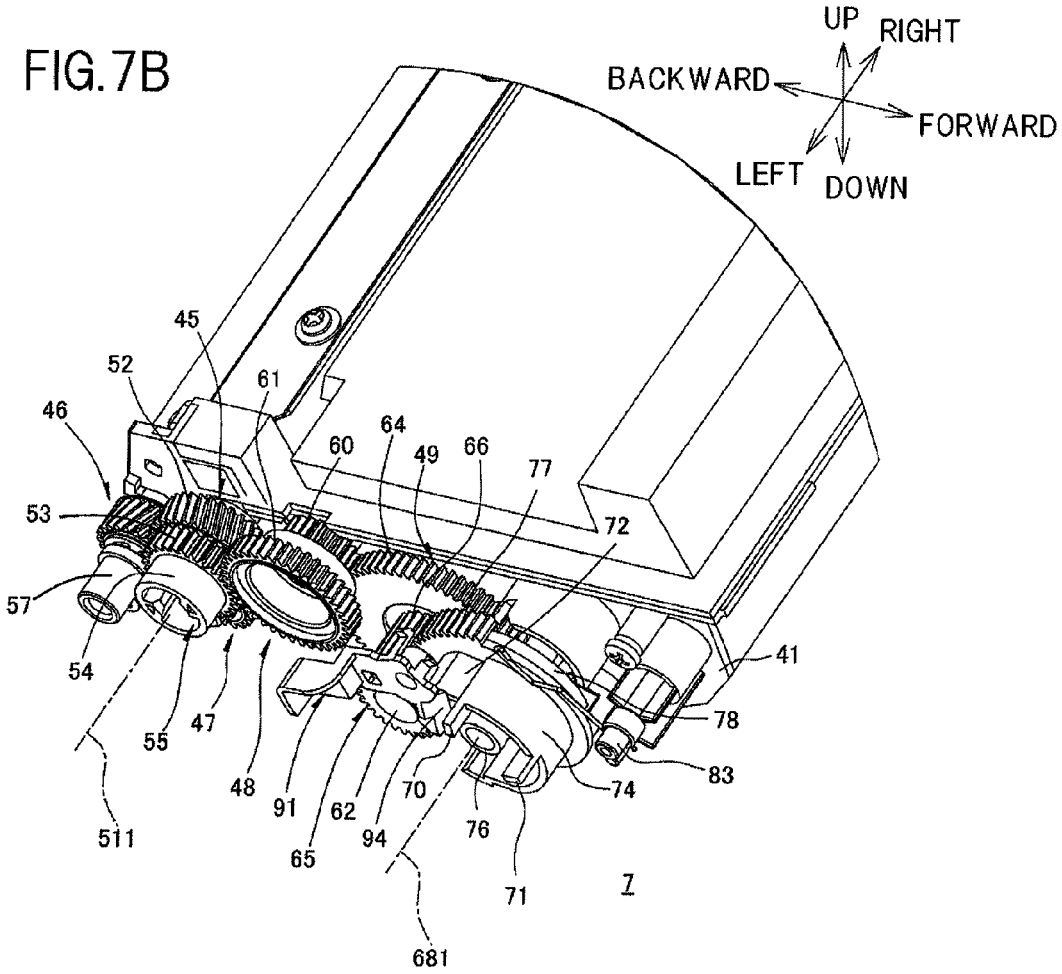
FIG. 7B is a schematic view of the developing cartridge shown in FIG. 7A from the vantage point of the left-front-top of the cartridge, with the gear cover removed.
Figure 7C:
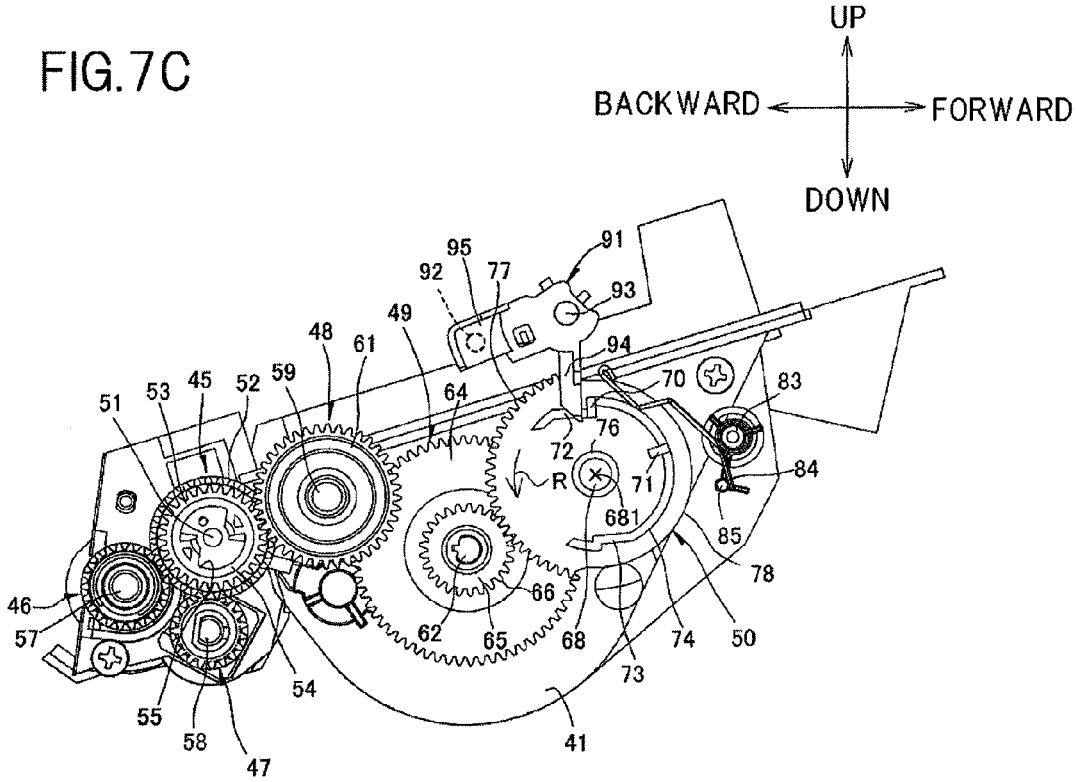
FIG. 7C is a left side view of the developing cartridge shown in FIG. 7A.
Figure 7D:
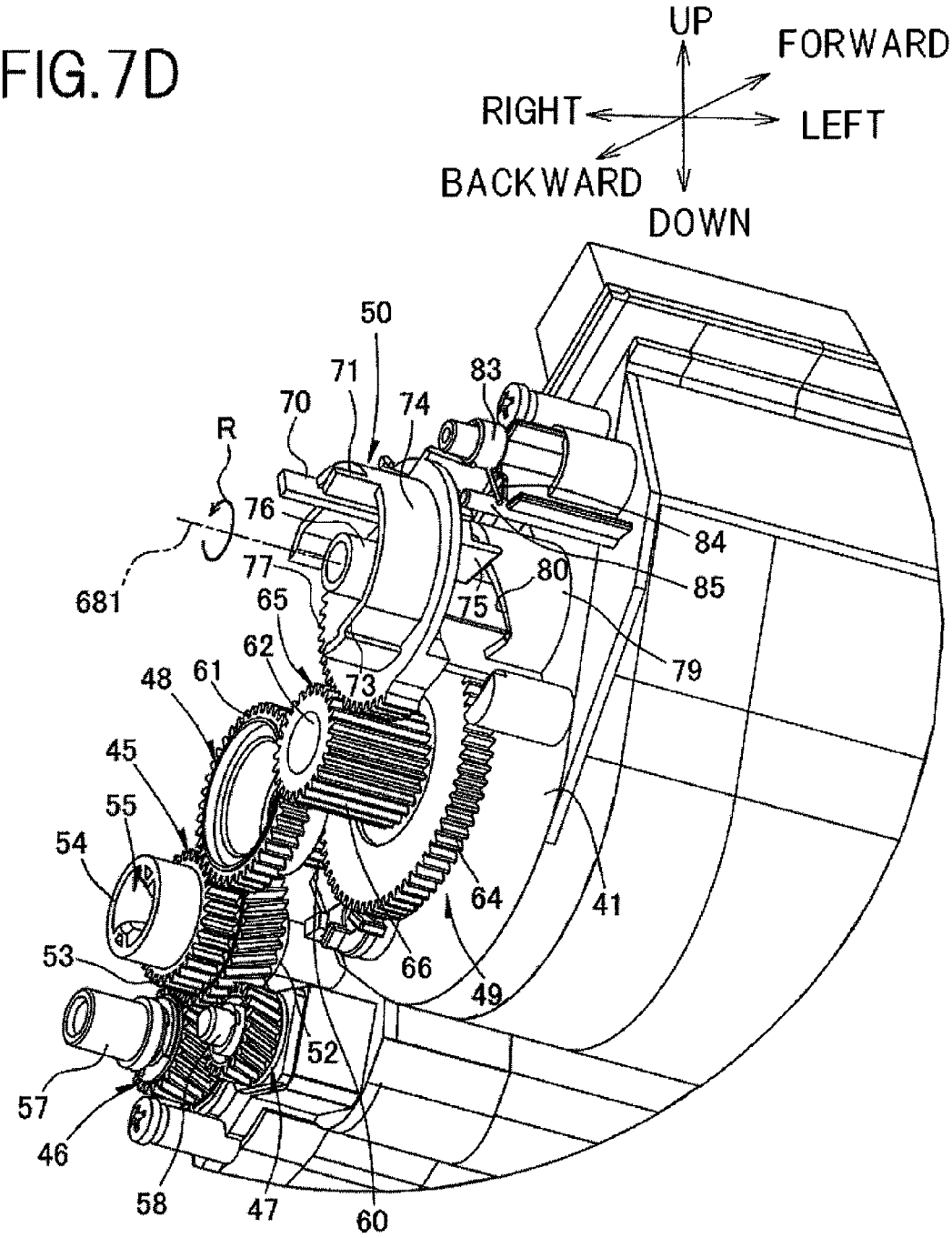
FIG. 7D is a schematic view of the developing cartridge shown in FIG. 7A from the vantage point of the left-front-bottom of the cartridge.
Figure 8A:
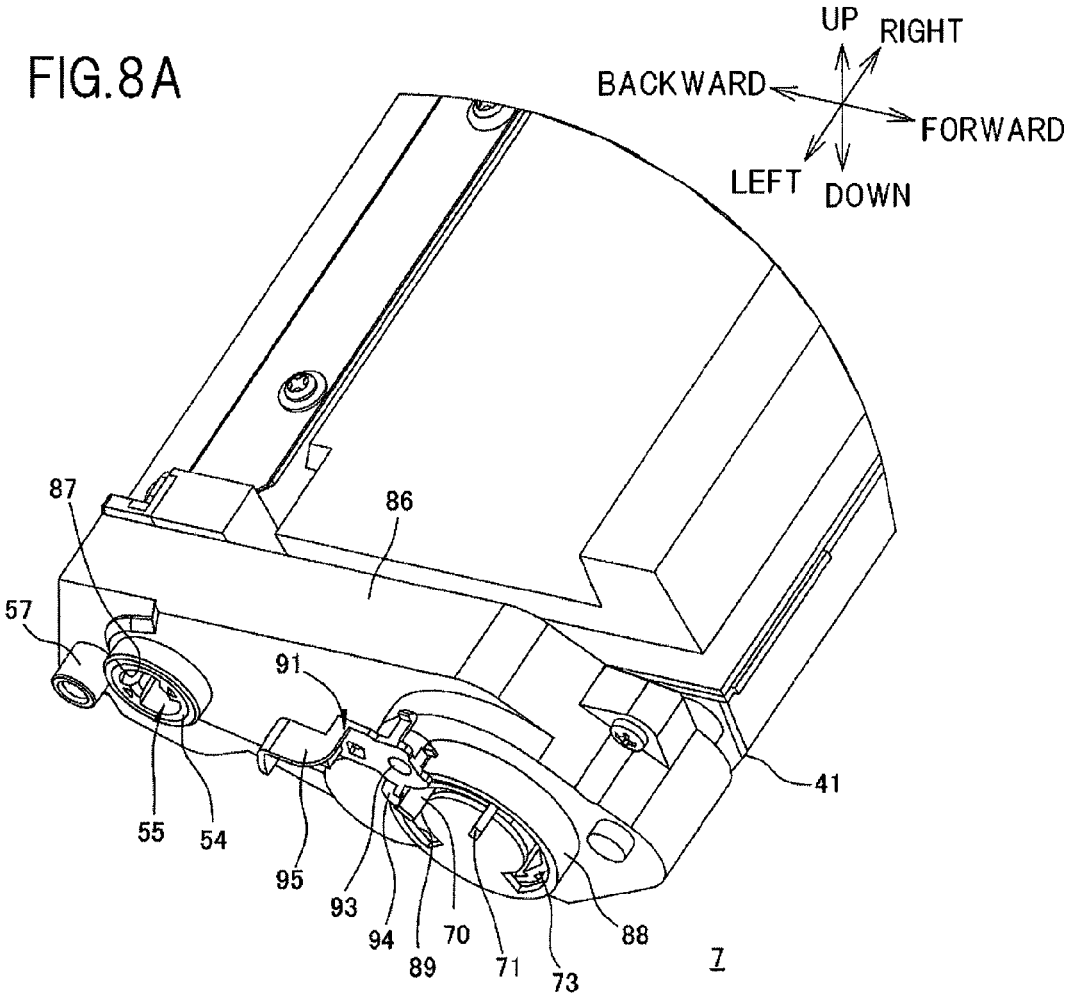
FIG. 8A is a schematic view of the developing cartridge from the vantage point of the left-front of the cartridge, with the detected rotational body rotated further from the position shown in FIG. 7A.
Figure 8B:
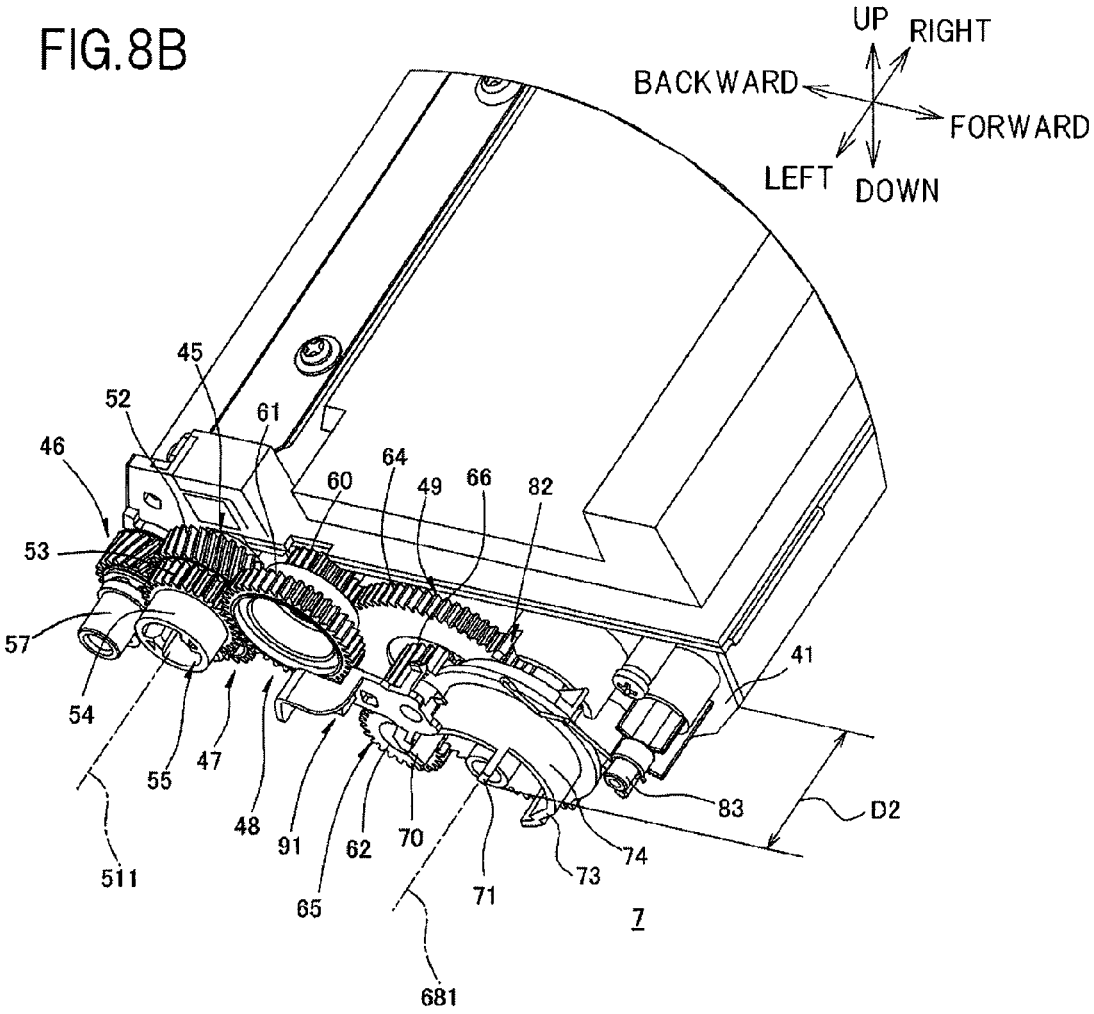
FIG. 8B is a schematic view of the developing cartridge shown in FIG. 8A from the vantage point of the left-front-top of the cartridge, with the gear cover removed.
Figure 8C:
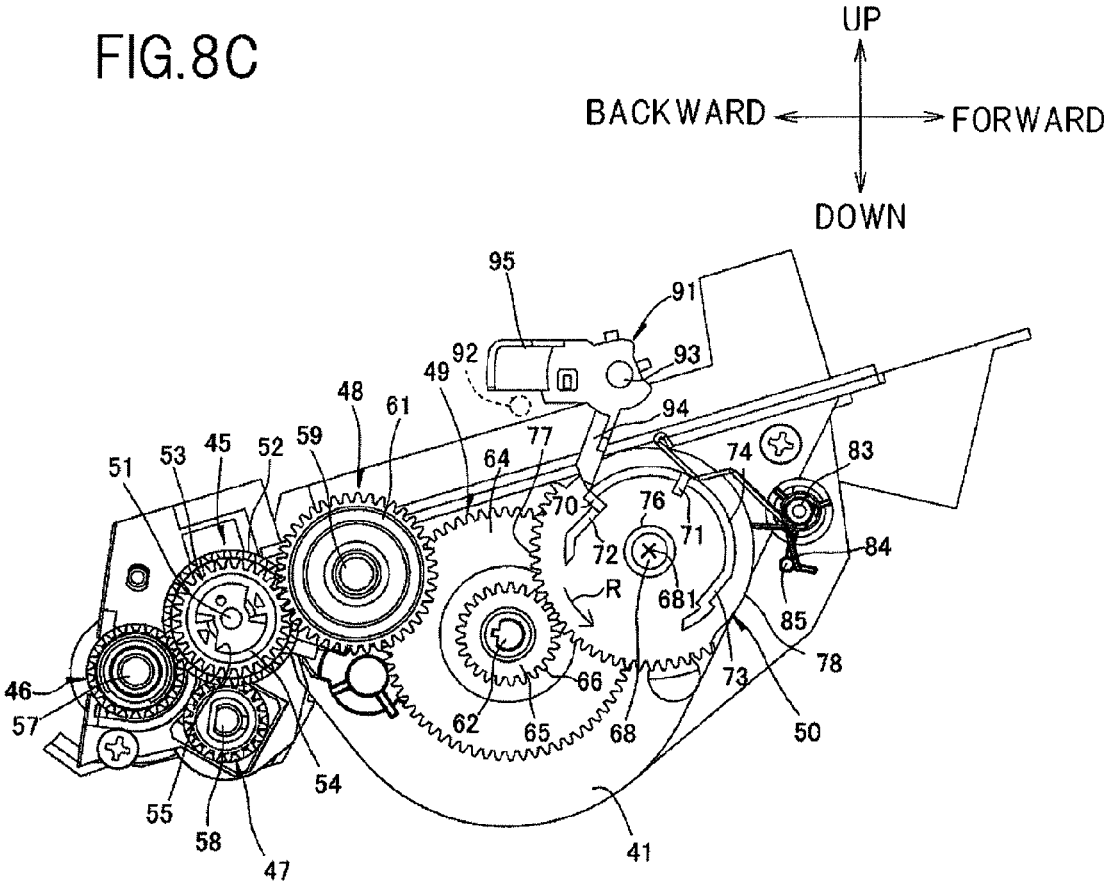
FIG. 8C is a left side view of the developing cartridge shown in FIG. 8A.
Figure 9A:
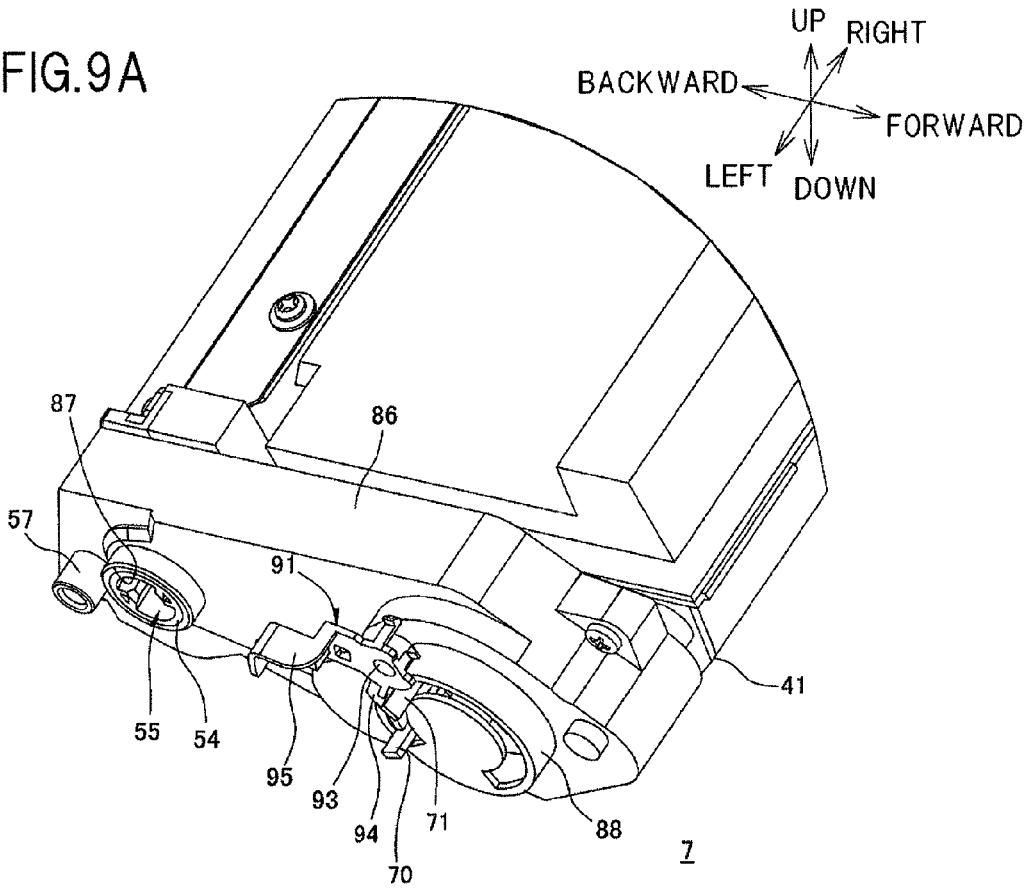
FIG. 9A is a schematic view of the developing cartridge from the vantage point of the left-front-top of the cartridge, with the detected rotational body rotated further from the position shown in FIG. 8A.
Figure 9B:
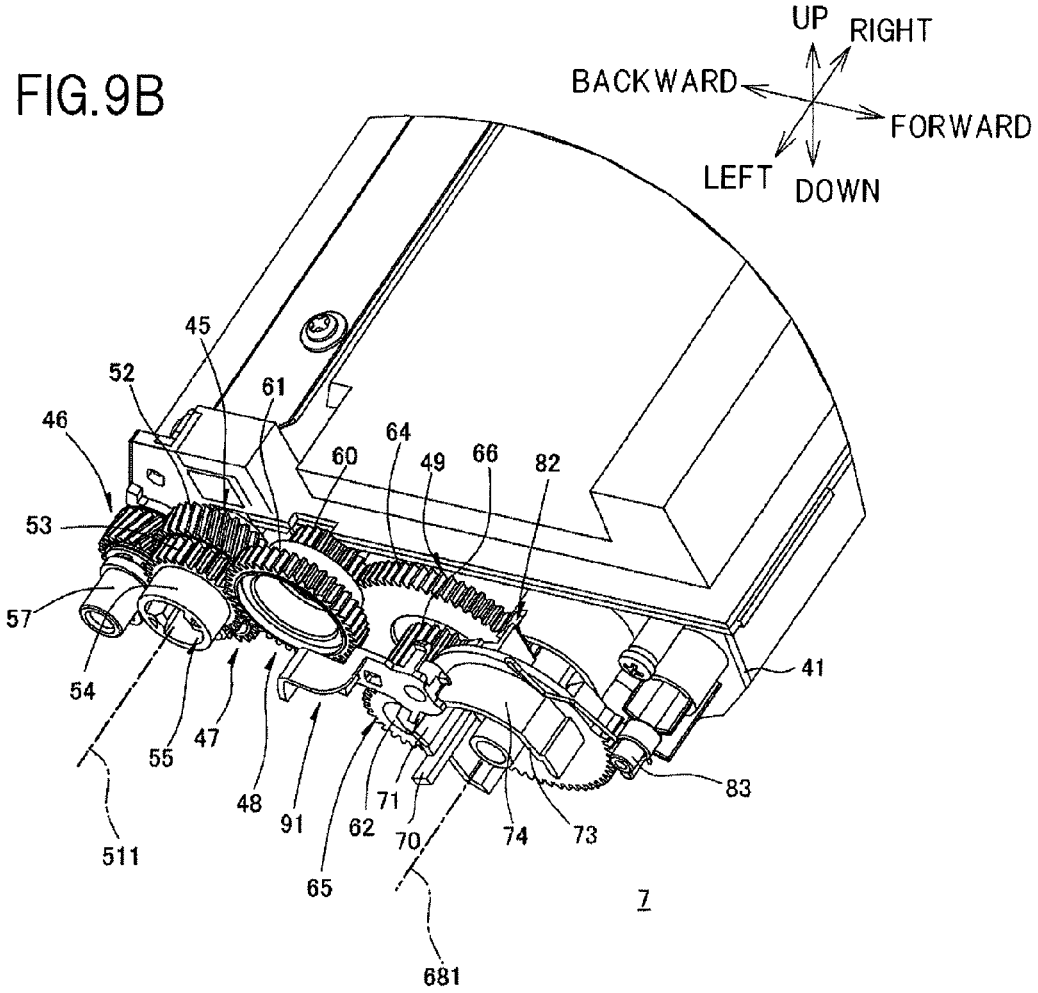
FIG. 9B is a schematic view of the developing cartridge shown in FIG. 9A from the vantage point of the left-front-top of the cartridge, with the gear cover removed.
Figure 9C:
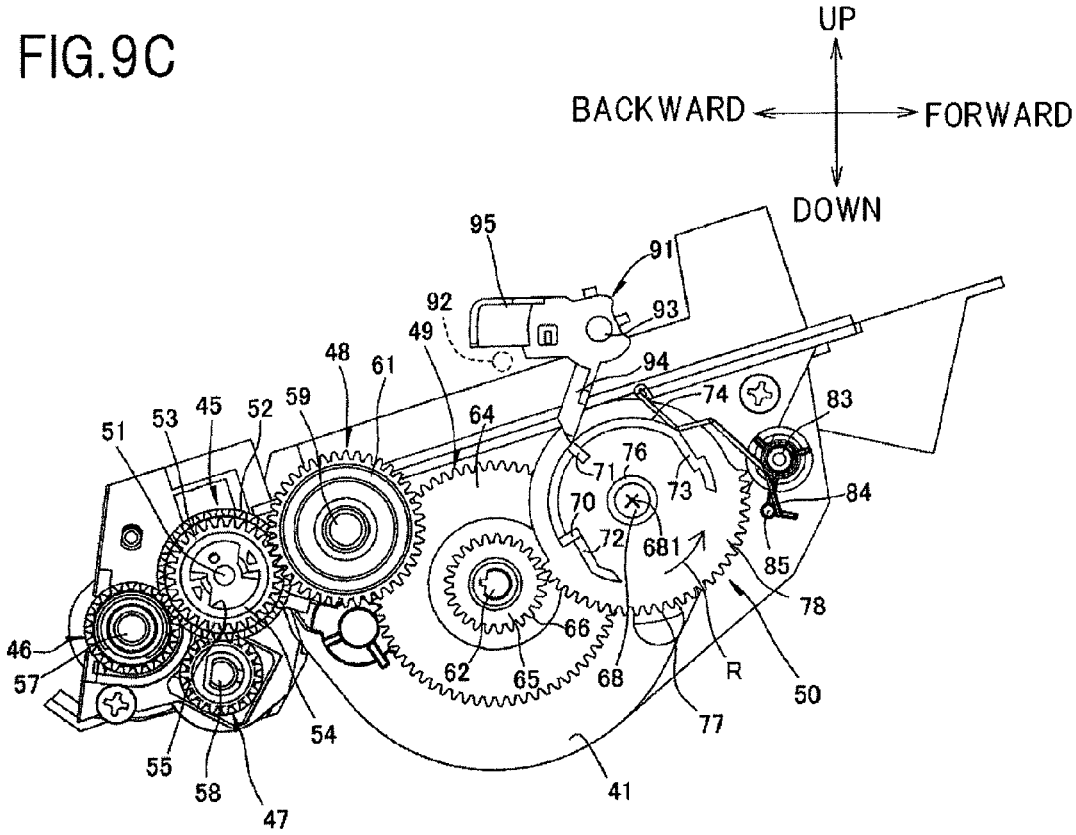
FIG. 9C is a left side view of the developing cartridge shown in FIG. 9A.
Figure 10A:
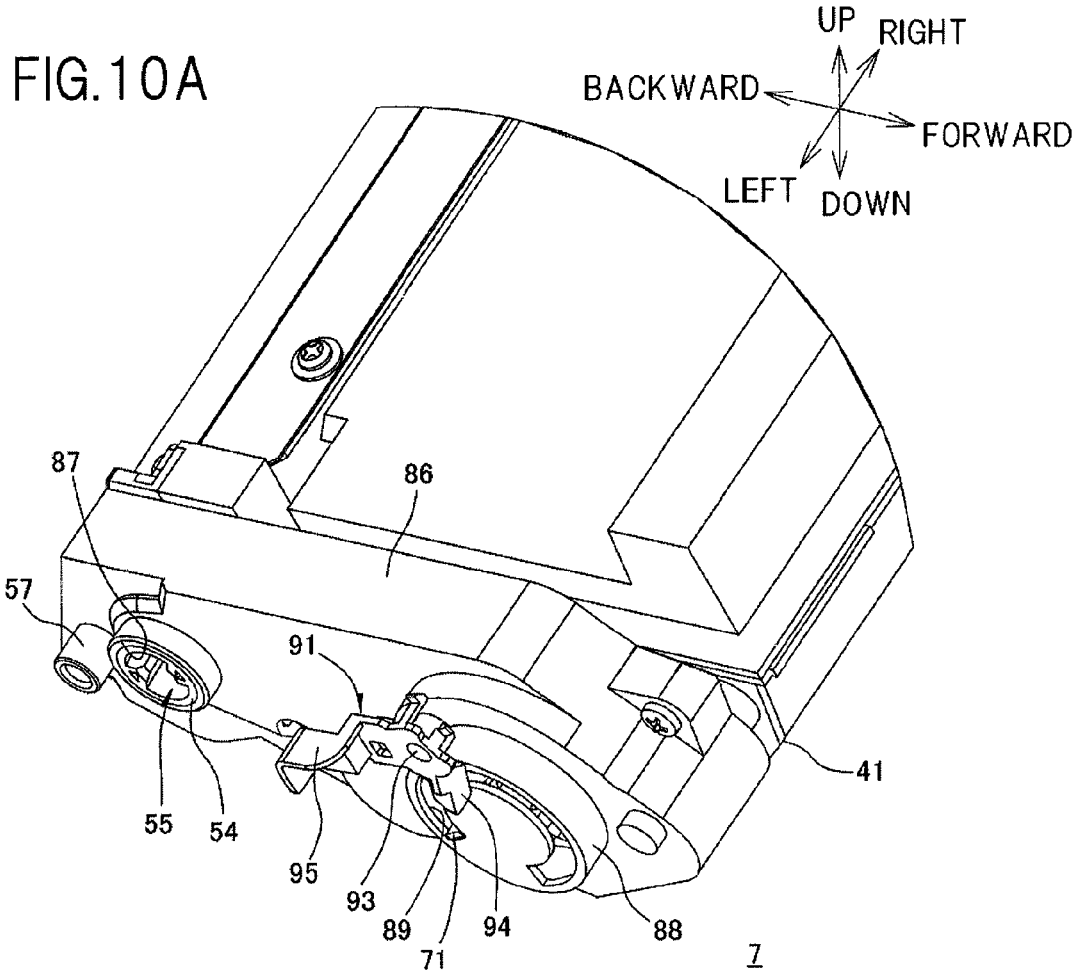
FIG. 10A is a schematic view of the developing cartridge from the vantage point of the left-front-lop of the cartridge, with the detected rotational body rotated further from the position shown in FIG. 9A.
Figure 10B:
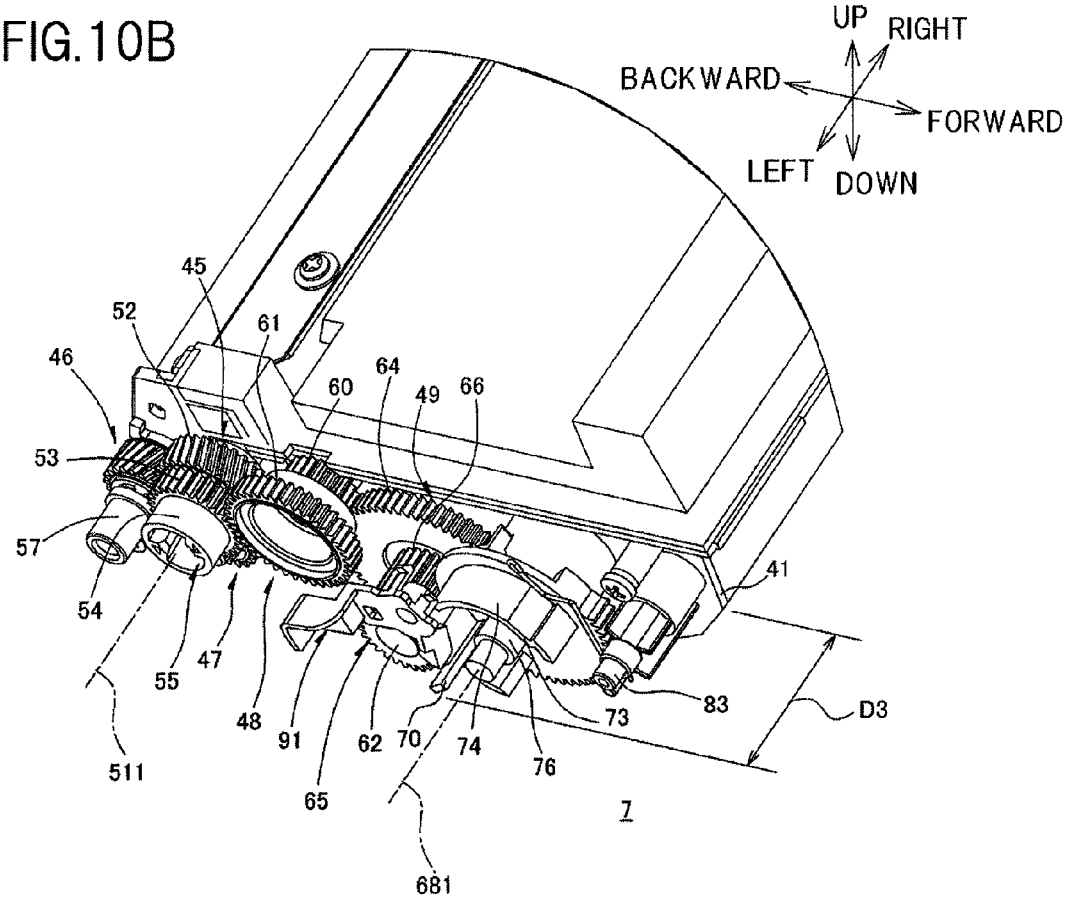
FIG. 10B is a schematic view of the developing cartridge shown in FIG. 10A from the vantage point of the left-front-top of the cartridge, with the gear cover removed.
Figure 10C:
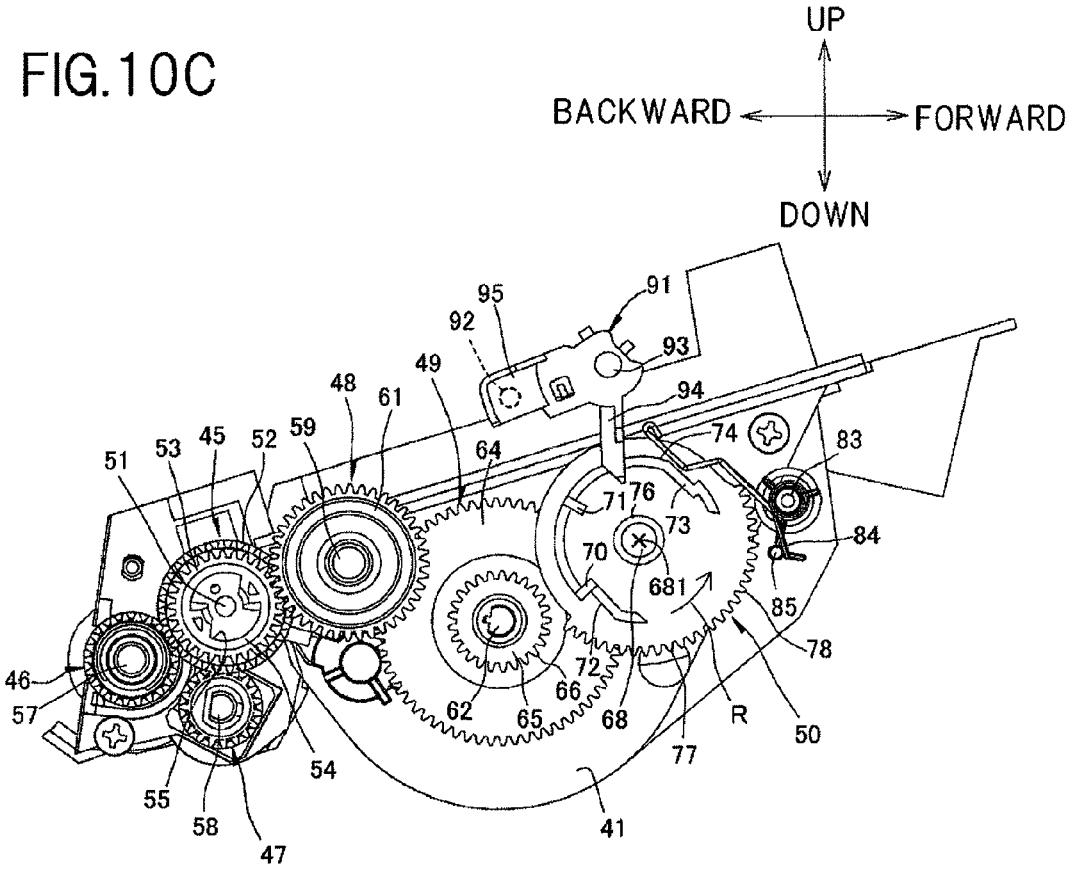
FIG. 10C is a left side view of the developing cartridge shown in FIG. 10A.

The actuator 91 is so provided as to swing between a non-measuring position, in which, as illustrated in FIGS. 4, 7C, and 10C, the contact lever 94 extends almost vertically downwards from the swinging axis 93, and the light shielding lever 95 extends substantially inclined both in the backward direction and in the downward direction, and a measuring position, in which, as illustrated in FIGS. 8C and 9C, the contact lever 94 extends substantially inclined both in the backward direction and in the downward direction, and the light shielding lever 95 extends backwards. The spring force of a spring (not shown) presses the actuator 91 to the non-measuring position absent other external forces.

The light sensor 92 includes a light emitting element and a light receiving element, both of which face each other in the right-to-left direction. The light sensor 92 is arranged in a position where a light path from the light emitting element to the light receiving element is shielded by the light shielding level 95 of the actuator 91 in the non-measuring position, and the light shielding lever 95 is retracted from the light path in the measuring position. When the light shielding lever 95 is retracted from (relieved of) the light path from the light emitting element to the light receiving element, the light sensor 92 outputs an on-signal.

4. Detecting for Installation of Developing Cartridge and for New Cartridge

As shown in FIGS. 2 to 4, the first and second detected parts 70 and 71 of the detected rotational body 50 is arranged, within a new developing cartridge 7, in the upper forward direction and in the lower forward direction, respectively, with respect to the rotation axis 68. The front ends of the first and second detected parts 70 and 71 are located substantially flush with the left end surface of the protrusion 88 of the gear cover 86. A lowermost portion of gear teeth 77 of the detected rotational body 50 downstream in the rotational direction R is engaged with the gear teeth 66 of the agitator gear 49. The wire spring 84 presses the toothless gear part 69 against the first side wall 41, being in contact with the left end surface of the toothless gear part 69 of the detected rotational body 50. The wire spring 84 also presses the first pressed part 72 backwards, being in contact with the front side of the first pressed part 72. Further, the supporting part 75 of the detected rotational body 50 is in contact with a portion of the left end surface of the sliding part 79 upstream beyond the inclined surface 80 in the rotational direction R.

Meanwhile, the right-to-left position of the detected rotational body 50 at this moment corresponds to an embodiment of a first position as an initial position. Moreover, the distance D1 (See FIG. 3) between the front end of the first detected part 70 and the first side wall 41 in the right-to-left direction is an embodiment of a first distance.

When the developing cartridge 7 is attached to the body casing 2, a warm-up operation of the laser printer 1 is performed. In the warm-up operation, the driving unit 56 (See FIG. 2) is inserted into the coupling recess 55 of the input gear 45, and the driving force is delivered from the driving unit 56 to the input gear 45, thereby rotating the input gear 45. In connection with the rotation of the input gear 45, the developing gear 46, the feed gear 47, and the intermediate gear 48 rotate, and the developing roller 18 and the feed roller 19 rotate. Accompanying the rotation of the intermediate gear 48, the agitator gear 49 and the agitator 16 (See FIG. 1) rotate. The rotation of the agitator 16 stirs up the developer contained in the developer cartridge 7.

Figure 11:
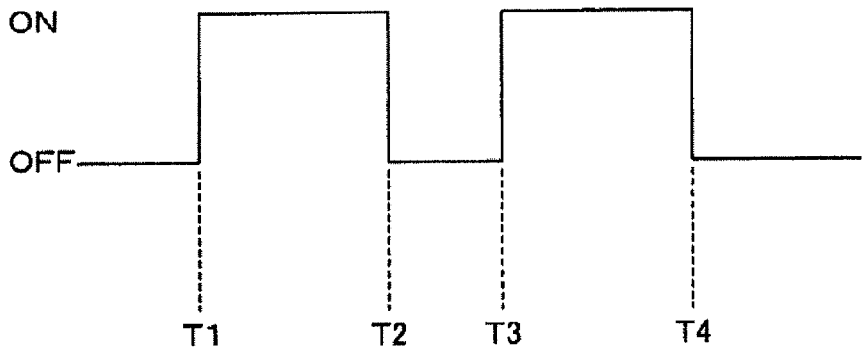
FIG. 11 is a timing chart showing the variation of the output signal of the light sensor at the time of the detection of the developing cartridge.

In a new developing cartridge 7, the gear teeth 66 of the agitator gear 49 are engaged with the gear teeth 77 of the detected rotational body 50. Thus, when the agitator gear 49 rotates, the detected rotational body 50 rotates in the rotational direction R subject to the rotation of the agitator gear 49. The first and second detected parts 70 and 71 are not in contact with the contact lever 94 of the actuator 91, immediately after the new developing cartridge 8 is attached to the body casing 2. Further, the actuator 91 is in the non-measuring position, and the contact lever 94 faces the opening 89 of the gear cover 86 in the right-to-left direction, and the light path of the light sensor 92 is shielded by the light shielding lever 95. Accordingly, the light sensor 92 outputs an off-signal, as before the time T1 shown in FIG. 11.

As illustrated in FIGS. 7A, 7B, 7C, and 7D, the rotation of the detected rotational body 50 moves the first and second detected parts 70 and 71 closer to the contact lever 94. At the same time, the supporting part 75 of the detected rotational body 50 slides toward the inclined surface 80 along the left end surface of the sliding part 79, and consecutively slides toward the parallel surface 81 along the inclined surface 80. Such rotation causes the detected rotational body 50 to move gradually in the left direction. Consequently, the first and second detected parts 70 and 71 advance gradually in the left direction as they move in the rotational direction R, and the front ends thereof projects through the opening 89 of the gear cover 86.

As the detected rotational body 50 rotates gradually, the front ends of the first and second detected parts 70 and 71 move in the left direction, and the front end of the first detected part 70 faces the contact lever 94.

Then, when the supporting part 75 of the detected rotational body 50 moves from the inclined surface 80 onto the parallel surface 81, the distance D2 between the front end of the first detected part 70 and the first side wall 41 in the right-to-left direction becomes the maximum.

Meanwhile, the position of the detected rotational body 50 in the right-to-left direction is an embodiment of a second position. Further, the maximum distance D2 (See FIG. 8B) at this moment is an embodiment of a second distance.

Subsequently, when the detected rotational body 50 rotates, the first detected part 70 is in contact with the contact lever 94. As the detected rotational body 50 rotates further, the first detected part 70 presses the contact lever 94 backwards, thereby setting the actuator 91 from the non-measuring position to the measuring position. Therefore, the light shielding lever 95 is relieved of the light path from the light emitting element to the light receiving element of the light sensor 92, and, thus, the light sensor 92 outputs an on-signal (as T1 in FIG. 11). Accordingly, the first detected part 70 may be indirectly detected by the light sensor 92.

Then, as the rotation of the detected rotational body 50 advances further, the first detected part 70 moves away from the contact lever 94, and the actuator returns from the measuring position to the non-measuring position. Consequently, the light path from the light emitting element to the light receiving element of the light sensor 92 is shielded by the light shielding lever 95, and the output signal from the light sensor 92 is changed from an on-signal to an off-signal (as T2 in FIG. 11). The supporting part 75 of the measureable rotational body 50 slides onto the parallel surface 81 of the sliding part 79.

When the detected rotational body 50 rotates further, as illustrated in FIGS. 9A, 9B, and 9C, the second detected part 71 becomes in contact with the contact lever 94, and presses the contact lever 94 backwards, thereby setting the actuator 91 from the non-measuring position to the measuring position again. Subsequently, the light shielding lever 95 is retracted from the light path from the light emitting element to the light receiving element of the light sensor 92, and thus an on-signal is outputted from the light sensor 92 (as T3 in FIG. 11), in this manner, the second detected part 71 may be detected indirectly by the light sensor 92. Still, the supporting part 75 of the detected rotational body 50 slides on the parallel surface 81 of the sliding part 79.

Afterwards, when the detected rotational body 50 rotates further, the second detected part 71 moves away from the contact lever 94, and the actuator 91 returns from the measuring position to the non-measuring position. Consequently; the light path from the light emitting element to the light receiving element of the light sensor 92 is shielded by the light shielding lever 95, and thus the output signal from the light sensor 92 is changed from an on-signal to an off-signal again (as T4 in FIG. 11). Still, the supporting part 75 of the detected rotational body 50 slides on the parallel surface 81 of the sliding part 79.

Furthermore, when the supporting part 75 slides further on the parallel surface 81, and then faces the notch portion 82, in response to the additional rotation of the detected rotational body 50, the supporting part 75 fits into the notch portion 82. Then, the detected rotational body 50 moves to the right at a stroke by the pressure force of the wire spring 84. Accordingly, as shown in FIG. 10A, the first and second detected parts 70 and 71 are retracted to the right, and the front ends thereof are arranged substantially flush with the left end surface of the protrusion 88 of the gear cover 86. At the same time, as illustrated in FIGS. 108 and 10C, the gear teeth 77 of the detected rotational body 50 is disengaged with the gear teeth 67 of the agitator gear 49, and the rotation of the detected rotational body 50 ceases.

Meanwhile, the position of the detected rotational body 50 in the right-to-left direction at this moment is an embodiment of a third position. Moreover, the distance D3 (See in FIG. 10B) between the front end of the first detected part 70 and the first side wall 41 in the right-to-left direction at this moment is an embodiment of a third distance, which is identical to the distance D1 in the embodiment described herein.

Afterwards, the wire spring 84 presses the toothless gear part 69 against the first side wall 41, being in contact with the left end surface of the toothless gear part 69 of the detected rotational body 50. Simultaneously, the wire spring 84 presses the second pressed part 73 backwards, being in contact with the front side of the second pressed part 73. As a result, the rotational position of the detected rotational body 50 remains in the same rotational position where the gear teeth 77 is disengaged with the gear teeth 67, and the detected rotational body 50 stays idle regardless of the rotation of the agitator gear 49.

As such, when a new developing cartridge 7 is first attached to the body casing 2, on-signals are outputted twice iron the light sensor 92. Therefore, when a developing cartridge 7 is attached to the body casing 2, the developing cartridge 7 may be determined as a brand-new cartridge if the output from the light sensor 92 generates two on-signals.

On the other hands, when an used developing cartridge 7 (a developing cartridge 7 that has ever been attached to the body casing 2) is attached to the body casing 2, the detected rotational body 50 does not rotate, even after a warm-up operation of the laser printer 1 begins, because the detected rotational body 50 is in a rotational position where the gear teeth 77 is disengaged with the gear teeth 67. Thus, if an on-signal is not outputted from the light sensor for a particular period of time after a developing cartridge 7 is attached to the body casing 2, the developing cartridge 7 may be determined as an used cartridge.

In the meantime, the second detected part 71 may be omitted. Absent the second detected part 71, an on-signal is outputted from the light sensor 92 only for a time period from T1 to T2 (See FIG. 11) when a new developing cartridge 7 is attached to the body casing 2. Therefore, the developing cartridge 7 may be determined as a new one with a single on-signal output from the light sensor 92.

For example, while the developing cartridge 7 with the second detected part 71 attached accommodates a relatively larger amount of a developer in the housing 13, the developing cartridge 7 without the second detected part 71 may accommodate a relatively smaller amount of a developer in the housing 13, if those new cartridges 7 are selectively attached to the body casing 2, the kind of a new attached developing cartridge 7 are distinguishable based on the number of on-signals output from the light sensor 92.

5. Technical Effects

As explained above, on the first side wall 41 of the housing 13 is the input gear 45 mounted rotatably around the center axis line 511 extending in the left-to-right direction, toward which the first and second side walls 41 and 42 faces respectively. The input gear 45 is connected with the driving unit 56 provided within the body casing 2, and is given a driving force from the driving unit 56.

The first side wall 41 is also provided thereon with the detected rotational body 50 including the first and second detected parts 70 and 71.

Further, the developing cartridge 7 includes a movable unit including the gear teeth 77, the sliding part 79 and the wire spring 84 of the detected rotational body 50. When the driving unit 56 inputs a driving force into the input gear 45, the movable unit allows the detected rotational body 50 to move from the first position. As a result, the first and second detected parts 70 and 71 of the detected rotational body 50 moves outwards (to the left), and then retracts inwards once they reach from the initial position (the position where the detected rotational body 50 is in the first position) to the outmost position in the direction of the first side wall 41 facing against the second side wall 42 (the position where the detected rotational body 50 is in the second position).

Specifically, the first position of the detected rotational body 50 is the position where the first detected part 70 is apart from the first side wall 41 at the distance D1 in the right-to-left direction. The detected rotational body 50 moves from the first position, via the second position where the distance in the moving direction between the first detected part 70 and the first side wall 41 is the distance D2 larger than the distance D1, to the third position where the distance in the moving direction between the first detected part 70 and the first side wall 41 is the distance D3 smaller than the distance D2.

Therefore, when the detected rotational body 50 is in the first position, the first and second detected parts 70 and 71 are retracted inwards from the outmost position. This feature may prevent the first and second detected parts 70 and 71 from being in contact with, or caught by, members within the body casing 2 when a developer cartridge 7 is attached to, or removed from, the body casing 2. That is, the feature may prohibit the hindrance of the first and second detected parts 70 and 71 to the installment or removal of the developing cartridge 7 within the body casing 2.

In other words, the developing cartridge 7 is configured as allowing the first and second detected parts 70 and 71 of the detected rotational body 50 to move along the center axis line 681 running parallel to the center axis line 511 that is the rotational axis line of the input gear 45. Therefore, the first and second detected parts 70 and 71 a detachable inwards or outwards with respect to the first side wall 41 while the features in prior art allows the first and second detected parts 70 and 71 of detected rotational body 50 only to move around the center axis line 681. Accordingly, this may prohibit the hindrance of the first and second detected parts 70 and 71 to the installment or removal of the developing cartridge 7 within the body casing 2.

Further, because the first and second detected parts 70 and 71 are retracted inwards from the outmost position before and after the detected rotational body 50 moves, such feature may prevent a crash of the first and second detected parts 70 and 71 with other members after a developing cartridge 7 is removed from the body casing 2. Thus, the damages of the first and second detected parts 70 and 71, for example, from a collision with other members may be prevented after the developing cartridge 7 is removed from the body casing 2.

In other words, the developing cartridge 7 is configured as allowing the first and second detected parts 70 and 71 of the detected rotational body 50 to move along the center axis line 681 running parallel to the center axis line 511 that is the rotational axis line of the input gear 45. Therefore, the first and second detected parts 70 and 71 a detachable inwards or outwards with respect to the first side wall 41 while the features in prior art allows the first and second detected parts 70 and 71 of the detected rotational body 50 only to move around the center axis line 681. Accordingly, the damages of the first and second detected parts 70 and 71, for example, from a collision with other members may be prevented after the developing cartridge 7 is removed from the body casing 2.

The detected rotational body 50 is supported rotatably around the center axis line 681 extending in the right-to-left direction, along which the detected rotational body 50 is movable, and rotates in the rotational direction R by a driving force transmitted to the input gear 45. In the meantime, the sliding part 79 is formed on the first side wall 41. The sliding part 79 includes the inclined surface 80 so tilted that the inclined surface 80 is more away from the first side wall 41 as it goes downstream in the rotational direction R. In response to the rotation of the detected rotational body 50 in the rotational direction R, the supporting part 75 of the detected rotational body 50 slides along the inclined surface 80 as the detected rotational body 50 moves from the first position to the third position, and, more specifically, as the detected rotational body 50 moves from the first position to the second position. Accordingly, it is assured that the first and second detected parts 70 and 71 of the detected rotational body 50 may be moved from the initial position to the outmost position. In other words, the sliding part 79 (specifically, the inclined surface 80) plays a function as a cam for transforming the rotational movement around the axes of the input gear 45, the intermediate gear 48 and the agitator gear 49 into the movement of the detected rotational body 50 movable in the direction parallel to the center axis line 511.

Downstream from the inclined surface 80 in the rotational direction R is the parallel surface 81 running parallel to the first side wall 41 formed integrally with the inclined surface 80. Therefore, while the supporting part 75 of the detected rotational body 50 is in contact with the parallel surface, the detected rotational body 50 may be maintained in the second position, and thus the first and second detected parts 70 and 71 that have been moved to the outmost position may be also maintained at that position.

The developing cartridge 7 is provided with the agitator 16. The agitator 16 is rotatably supported on the first and second side walls 41 and 42, and is rotated by a driving force given to the input gear 45. The rotation of the agitator 16 may stir up the developer contained in the housing 13.

The developing cartridge 7 is also provided with the agitator gear 49. The detected rotational body 50 includes its circumferential surface around the center axis line 681. The toothless portion 78 is formed on a portion of the circumferential surface, and the gear teeth 77 are formed on the remaining portion (other than the toothless portion 78) of the circumferential surface. The engagement of the gear teeth 77 with the gear teeth 67 of the agitator gear 49 transmits the driving force received by the input gear 45, via the agitator gear 49, to the detected rotational body 50. The detected rotational body 50, then, moves from the first position to the third position while rotating in the rotational direction R. When the detected rotational body 50 moves to the third position, the toothless portion 78 on the circumferential surface of the detected rotational body 50 faces the agitator gear 49, and the gear teeth 77 on the circumferential surface of the detected rotational body 50 is disengaged with the gear teeth 67 of the agitator gear 49. Therefore, when the detected rotational body 50 moves to the third position, the detected rotational body 50 may stay idle regardless of the rotation of the agitator gear 49.

The boss 83 projects from the first side wall 41, extending in the right-to-left direction. The wire spring 84 is coiled around the boss 83. One end portion of the wire spring 84 is in contact with the side of the detected rotational body 50 opposite to the first side wall 41. This feature presses the detected rotational body 50 against the first side wall 41. Thus, the detected rotational body 50 may be pressed against the first side wall 41 by such a simple structure as the wire spring 84, and the detected rotational body 50 may assuredly be moved from the second position to the third position.

Furthermore, the detected rotational body 50 includes the second pressed part 73, which is in contact with the wire spring 84 from the upstream in the rotational direction R when the detected rotational body 50 is in the third position. Therefore, the wire spring 84 may press the detected rotational body 50 in the rotational direction R as well as against the first side wall 41 when the detected rotational body 50 is in the third position. Accordingly, the detected rotational body 50 may be fixed both in the moving direction and in the rotational direction R.

The detected rotational body 50 as a whole including the first and second detected parts 70 and 71 is covered by the gear cover 86. Further, the first and second detected parts 70 and 71 are exposed out of the gear cover 86 when the detected rotational body 50 is in the second position. Therefore, the hindrance of the first and second detected parts 70 and 71 to the installment or removal of the developing cartridge 7 within the body casing 2, and the damages of the first and second detected parts 70 and 71, for example, from the collision with other members, may assuredly be prevented, while the detected rotational body 50 may assuredly be detected by the detecting unit mounted within the body casing 2 when the detected rotational body 50 is in the second position.

Each position of the first and second detected parts 70 and 71 in the rotational direction R is not limited to the position explained above, and is freely changeable by the modification of the positions of the detected rotational body 50 and the sliding part 79 in the rotational direction R. As such, each position of the first and second detected parts 70 and 71 in the rotational direction R when the detected rotational body 50 is in the second position may be changed to any angle among 360 degrees around the center axis line 681. This increases the level of freedom of arranging the actuator 91 and the light sensor 92 in the body casing 2 mounting the developing cartridge 7.

6. Other Embodiments

(1) Modified Embodiment 1

In the configuration of the embodiment explained above, the distance D1 (See FIG. 3) in the right-to-left direction between the front end of the first detected part 70 and the first side wall 41 when the detected rotational body 50 is in the first position is identical to the distance D3 (See FIG. 10B) in the right-to-left direction between the front end of the first detected part 70 and the first side wall 41 when the detected rotational body 50 is in the third position. However, the distance D3 may be larger or smaller than the distance D1 so long as the distance D3 is smaller than the distance D2 (See FIG. 8B) in the right-to-left direction between the front end of the first detected part 70 and the first side wall 41.

(2) Modified Embodiment 2

In the configuration of the embodiment explained above, the front ends of the first and second detected parts 70 and 71 are arranged substantially flush with the left end surface of the protrusion 88 of the gear cover 86 when the detected rotational body 50 is in the first or third position. However, the front ends of the first and second detected parts 70 and 71 may be completely hidden within the gear cover 86, or may substantially project out from the gear cover 86, when the detected rotational body 50 is in the first or third position.

(3) Modified Embodiment 3

While the gear cover 86 is attached to the outside of the first side wall 41 in the previous embodiment, it may be included in the first side wall 41. That is, the first side wall may be configured as the combination of the gear cover 86 and the first side wall 41 as an example of a side wall body. In this case, the detected rotational body 50 may be attached to the side wall body, or to the gear cover 86.

(4) Modified Embodiment 4

If the sliding part 79 only includes, on its left side surface, a parallel surface running parallel to the first side wall 41, a circular arc-shaped supporting part (instead of the supporting part 75 of the detected rotational body 50) may be configured around the center axis line 681 on the right side surface of the toothless gear part 69, and an inclined surface may be formed on the right end surface of that supporting part in such a way that the inclined surface is more apart from the first side wall 41 as it goes downstream of the rotational direction R of the detected rotational body 50. This configuration may also allow the detected rotational body 50 to move from the first position to the third position in response to the rotation of the detected rotational body 50.

(5) Modified Embodiment 5

In the configuration of the embodiment explained above, the detected rotational body 50 includes the toothless gear part 69, and the sliding part 79 is configured between the first side wall 41 and the detected rotational body 50. Further, the driving force is transmitted iron the agitator gear 49 to the toothless gear part 69, and the first and second detected parts 70 and 71 advances or retracts, while rotating in the rotational direction R, in response to the rotation of the detected rotational body 50. Instead of this configuration, the features illustrated in FIGS. 12 *and* 13 may be employed.

Figure 13:
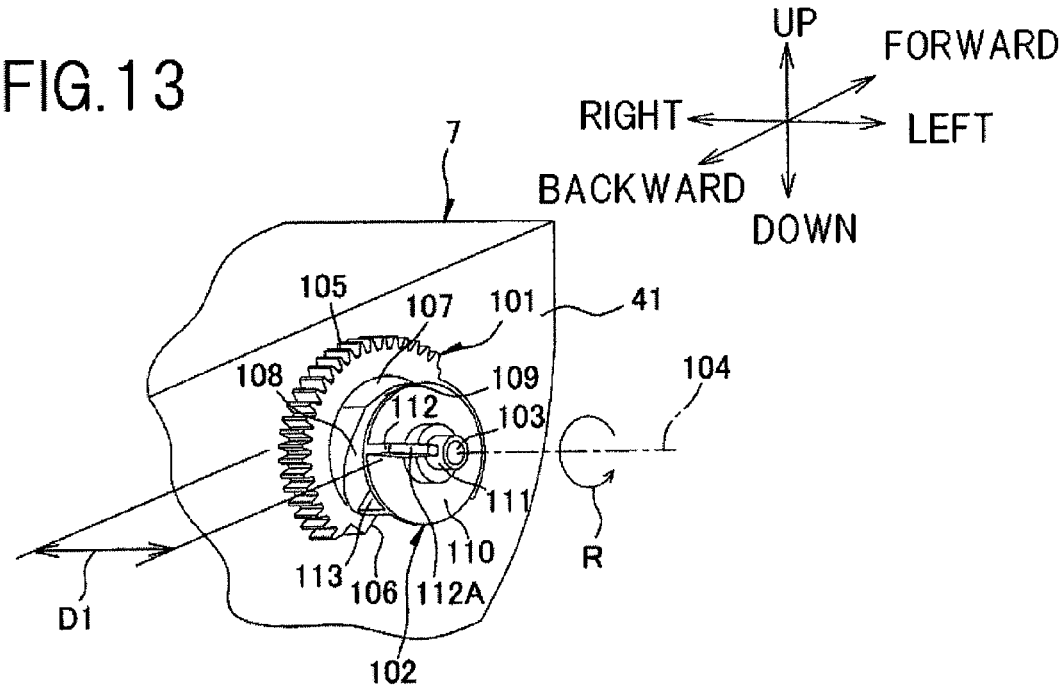
FIG. 13 is a schematic view of the main part of the developing cartridge shown in FIG. 12 from the vantage point of the left-back-top of the cartridge, with the gear cover removed.

Specifically, in the configuration illustrated in FIG. 13, a toothless gear 101 and a detected body 102 are provided on the outer side of the first side wall 41.

The toothless gear 101 is arranged front above the agitator gear 49 (See FIG. 4), the same arrangement as the detected rotational body 50 in FIG. 4. The toothless gear 101 is provided rotatably around the center axis line 104, which is an example of the third axis line of a rotation axis 103 extending in the right-to-left direction. The rotation axis 103 is unrotatably supported on the first side wall 41.

Further, the toothless gear 101 is substantially in the shape of a half-circular plate, and includes gear teeth 105 on its circumferential surface. Specifically, the toothless gear 101 is similar to a fan-shaped plate when viewed from the side of about 205-degree angle. A toothless portion 106 is allocated on a flat-shaped portion on the circumferential surface of the toothless gear 101, and the gear teeth 105 is formed on the remaining arc-shaped portion (other than the toothless portion 106) of the circumferential surface. Depending on the rotational position of the toothless gear 101, the gear teeth 105 may be engaged with the smaller diameter part 65 of the agitator gear 49.

The toothless gear 101 includes a sliding part 107 formed integrally on the left end surface (outer surface) of the gear 101. The sliding part 107 includes (a) an inclined surface 108 so tilted as to be more apart from the left side surface (the first side wall 41) of the toothless gear as it goes upstream in the rotational direction R, which is an example of the second direction of the toothless gear 101, and (b) a parallel surface 109 extending from the upstream of the inclined surface 108 in the rotational direction R and running parallel to the left side surface (the first side wall 41) of the toothless gear 101.

The detected body 102 is supported on the rotation axis 103, and is provided movably in the right-to-left direction. The detected body 102 includes, as an integral body, a circular plate-shaped body 110, a insert-penetrating boss 111 and a detected part 112 projecting from the left side surface (outer surface) of the body 110, and a supporting part 113 projecting from the right side surface (inner surface) of the body 110.

The wire spring 84 (See FIG. 4) is in contact with the left side surface of the body 110 from the left side, and presses the body 110 against the first side wall 41.

The insert-penetrating boss 111 has a cylindrical shape coaxially arranged with the body 110. The detected body 102 is provided movably along the rotation axis 103 by inserting the rotation axis 103 into the insert-penetrating boss 111, and by passing the rotation axis 103 through the insert-penetrating boss 111, in a freely movable way.

The detected part 112 is in a plate shape extending both in the right-to-left direction and in the diametric direction of the body 110 on the left side surface of the body 110. Further, the detected part 112 has a trapezoidal shape, as viewed from the top, including an inclined surface 112A so tilted as to be closer to the left side as it goes to the front.

The supporting part 113 has the shape of a rectangular plate extending both in the right-to-left direction and in the diametric direction of the body 110.

Figure 12:
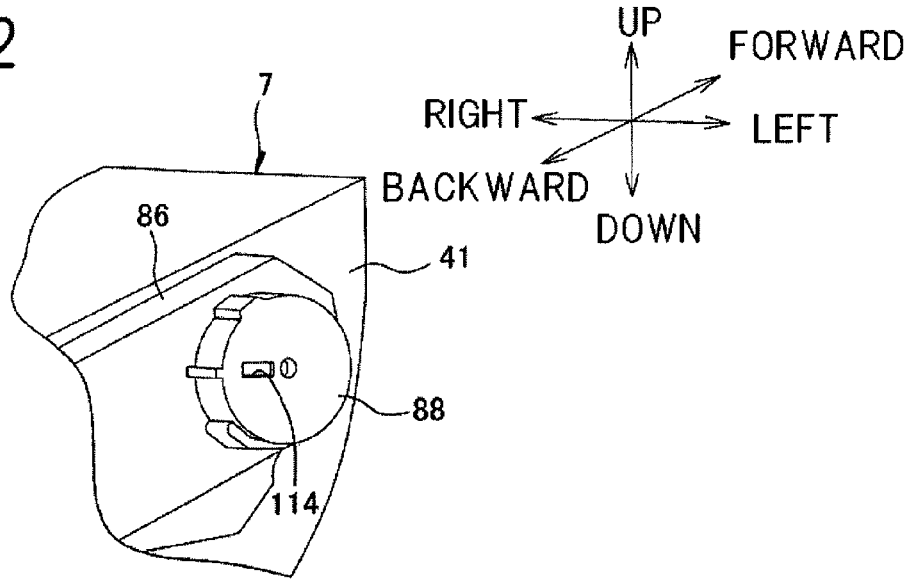
FIG. 12 is a schematic view of the main part of the developing cartridge, from the vantage point of the left-back-top of the cartridge, adopting the configuration (modified embodiment 5) in which the toothless gear and the detected body are separately mounted.

As shown in FIG. 12, instead of the opening 89 as illustrated in FIG. 2, a rectangular shaped opening 114 is formed at the place of the gear cover 86 corresponding to the detected part 112.

In a new developing cartridge 7, as illustrated in FIG. 13, the supporting par 113 of the measure part 102 is located downstream from the inclined surface 108 of the sliding part 107 in the rotational direction R, and thus is in contact with the left side surface of the toothless gear 101. Further, the lowermost portion of the gear teeth 105 of the toothless gear 101 downstream in the rotational direction R is engaged with the gear teeth 66 of the agitator gear 49. Moreover, the detected part 112 is accommodated in the gear cover 86, and thus is not protruded out of the opening 114.

The position of the detected body 102 in the right-to-left direction at this moment is an example of the first position as the initial position. Further, the distance D1 (See FIG. 13) in the right-to-left direction between the front end of the detected part 112 and the first side wall 41 is an example of the first distance.

In a new developing cartridge 7, the gear teeth 66 of the agitator gear 49 are engaged with the gear teeth 105 of the detected body 102. Thus, when the agitator gear 49 rotates in the course of the warm-up operation of the laser printer 1, the toothless gear 101 rotates in the rotational direction R subject to the rotation of the agitator gear 49. The rotation of the toothless gear 101 allows the supporting part 113 of the detected body 102 to slide toward the inclined surface 108 on the left side surface of the toothless gear 101, and consecutively to slide toward the parallel surface 109 on the inclined surface 108. Accordingly, the detected body 102 moves gradually leftwards. That is, the detected body 102 advances gradually in the left direction without any rotational movement, and, thus, the front end of the detected body 102 projects out from the opening 114 of the gear cover 86.

Moreover, when the supporting part 113 moves onto the parallel surface 109 in response to the rotation of the toothless gear 101, the distance in the right-to-left direction between the front end of the detected part 112 and the first side wall 41 becomes the maximum, thereby making the position of the detected body 102 the second position.

Afterwards, when the toothless gear 101 rotates further, the supporting part 113 falls down from the parallel surface 109 to the left side surface of the toothless gear 101. The detected body 102 then moves to the right at a stroke by the pressure of the wire spring 84. As a result, the detected part 112 retracts to the right, and its front end sinks under the gear cover 86, thereby making the position of the detected body 102 the third position.

The detected body 102 is detected by a measuring unit (not shown) attached to the body casing 2 when the distance in the right-to-left direction between the front end of the detected part 112 and the first side wall 41 is the maximum. For example, a light sensor including a light emitting element and a light receiving element, both of which face each other, is attached to the body casing 2. An actuator is provided at a place facing the detected part 112 in the right-to-left direction in the body casing 2, and may swing around an axis line extending in the right-to-left direction. While the detected body 102 is displaced from the first position to the second position, the inclined surface 112A of the detected part 112 is in contact with the actuator. As the detected part 112 moves accordingly, the inclined surface 112A pushes away the actuator, which then runs away off the detected part 112 backwards. Then, when the distance in the right-to-left direction between the front end of the detected part 112 and the first side wall 41 is the maximum, the actuator becomes arranged along the light path from the light emitting element to the light receiving element, and thus shields the light path. In this manner, the detected body 102 may be detected by the light sensor.

The configurations shown in FIGS. 12 and 13 may accomplish the same technical effects as the embodiment previously explained.

As mentioned above, the supporting part 113 of the detected body 102 has the shape of a rectangular plate extending both in the right-to-left direction and in the diametric direction of the body 110, and the sliding part 107 of the toothless gear 101 includes the inclined surface 108 and the parallel surface 109. Alternatively, the supporting part 113 may include (a) an inclined surface so tilted that the inclined surface is more away from the right side surface of the body 110 of the detected body 102 as it goes upstream in the rotational direction R of the toothless gear 101, and (b) an parallel surface extending from the upstream of the inclined surface in the rotational direction and running parallel to the right side surface of the body 110. In this alternative features, the sliding part 107 of the toothless gear 101 has the shape of a rectangular plate extending both in the right-to-left direction and in the diametric direction of the toothless gear 101.

(6) Modified Embodiment 6

In the configuration of the embodiment explained above, when the developing cartridge 7 is brand-new, the wire spring 84 presses the toothless gear part 69 of the detected rotational body 50 against the first side wall 41, and also presses the first pressed part 72 backwards of the detected rotational body 50. Alternatively, the features may be selected as shown in FIGS. 14A, 14B, 14C, 15A, 15B, 16A, and 16B. For clarification, the structures in FIGS. 14A to 16B distinguished from the previous embodiment are only explained below.

Figure 14A:
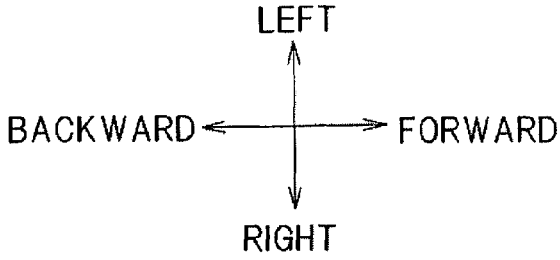
FIG. 14A is a sectional view of the first side wall of the developing cartridge adopting the configuration (modified embodiment 6) including the coil spring as a pressing member.
Figure 14A:
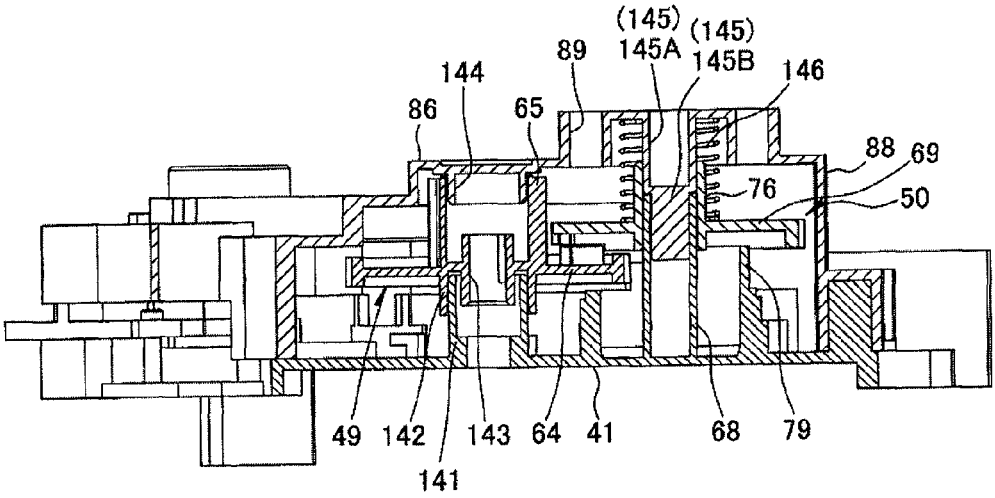

As illustrated in FIG. 14A, the first side wall 41 has a cylindrical agitator rotation axis insert-penetrating part 141 extending in the right-to-left direction.

The agitator gear 49 includes a cylindrical part 142 having an inner diameter substantially larger than the outer diameter of the agitator rotation axis insert-penetrating part 141. Further, the larger diameter gear part 64 has the shape of a circular plate (flange) protruding circumferentially from the middle of the axis line of the cylindrical part 142, and includes gear teeth on its circumferential surface. The cylindrical part 142 has a side of the smaller diameter gear part 65 facing the larger diameter gear part 64. The smaller diameter gear part 65 includes gear teeth on its circumferential surface.

On inner side of the cylindrical part 142 is a cylindrical agitator rotation axis fixing part 143 formed. The agitator rotation axis fixing part 143 has a center axis line identical to that of the cylindrical part 142.

Corresponding to the agitator rotation axis insert-penetrating part 141, the fitting part 4 is formed on the inner side of the gear cover 86. When the gear cover 86 is attached to the first side wall 41, the fitting part 144 has a cylindrical shape coaxially arranged with the agitator rotation axis insert-penetrating part 141, and has a outer diameter substantially smaller than the inner diameter of the cylindrical part 142, i.e. a outer diameter substantially the same as the outer diameter of the agitator rotation axis insert-penetrating part 141.

The agitator gear 49 is rotatably supported between the first side wall 41 and the gear cover 86 by inserting the agitator rotation axis insert-penetrating part 141 into the end of the cylindrical part 142 on the side of the larger diameter gear part 64, and by fitting the fitting part 144 to the other end of the cylindrical part 142 when the gear cover 86 is attached to the first side wall 41.

Then, the agitator axis 62 (See FIG. 6) is inserted into, and passes through, the agitator rotation axis insert-penetrating part 141, and the left end of the agitator axis 62 is inserted into the agitator rotation axis fixing part 143. The left end of the agitator axis 62 has a D-sectional shape, in which a portion of the circumferential surface is formed as a flat surface. The inner circumferential surface of the agitator rotation axis fixing part 143 includes the convex surface that is able to be in surface-to-surface contact with the flat surface of the left end of the agitator axis 62. Thus, when the left end of the agitator axis 62 is inserted to the agitator rotation axis fixing part 143, the agitator rotation axis fixing part 143 is unrotatably coupled with the agitator axis 62.

The rotation axis 68 of the detected rotational body 50 is formed integrally with the first side wall 41, and has a cylindrical shape extending leftwards from the first side wall 41.

Corresponding to the rotation axis 68, a boss 145 is formed in the inner surface of the gear cover 86. The boss 145 is designed to be coaxially arranged with the rotation axis 68 when the gear cover 86 is attached to the first side wall 41. The base end 145A of the boss 145 is in a cylindrical shape having an outer diameter substantially smaller than the inner diameter of the insert-penetrating boss 76 and substantially larger than the inner diameter of the rotation axis 68. The front end 145B of the boss 145 is in the shape of a cylindrical column having an outer diameter substantially smaller than the inner diameter of the rotation axis 68.

The detected rotational body 50 is rotatably supported between the first side wall 41 and the gear cover 86 by inserting the front end 1458 of the boss 145 to the rotation axis 68 when the front end of the rotation axis 68 is inserted to the insert-penetrating boss 76, and the gear cover 86 is attached to the first side wall 41.

Moreover, being inserted to the insert-penetrating boss 76 and the boss 145, a coil spring 146, as an example of a press member, is provided between the toothless gear part 69 of the detected rotational body 50 and the inner surface of the gear cover 86. The pressure force (elastic force) of the coil spring 146 presses the detected rotational body 50 against the first side wall 41.

Figure 16A:
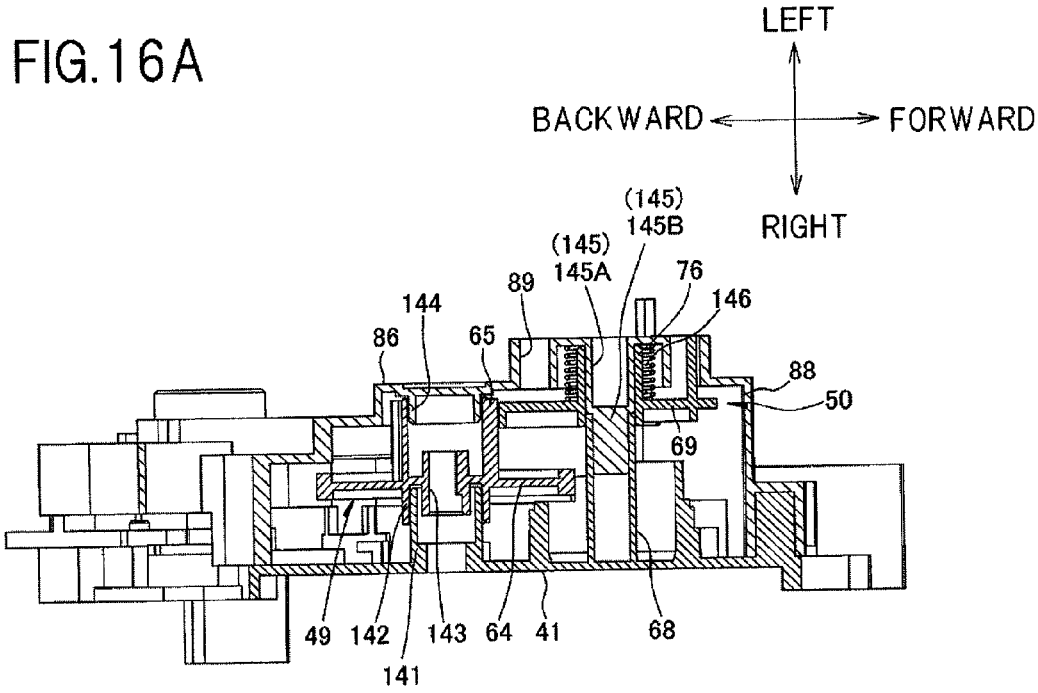
FIG. 16A is a sectional view of the first side wall of the developing cartridge shown in FIG. 14A, with the detected rotational body arranged at the farthest position leftwards.
Figure 16B:
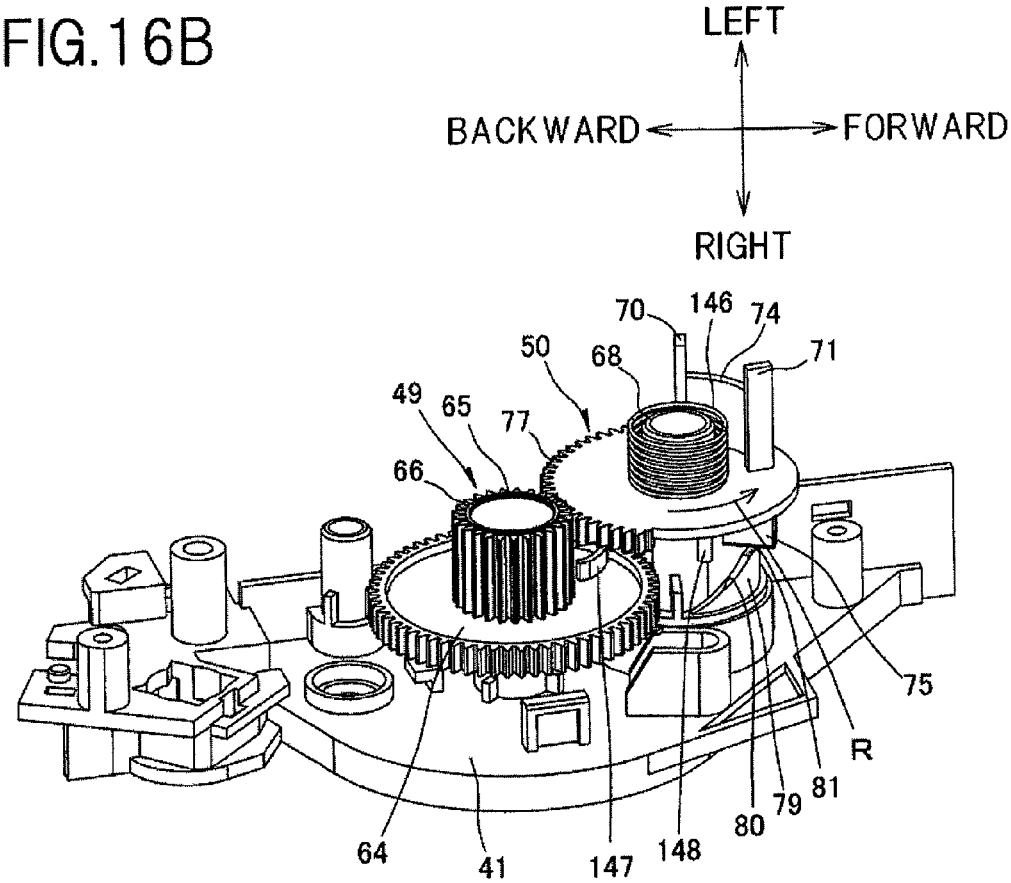
FIG. 16B is a schematic view of the first side wall of the developing cartridge at the position shown in FIG. 16A, from the vantage point of the left-bottom.

As shown in FIG. 16B, a substantially circular arc-shaped pressing part 147, which extends substantially in the diametric direction of the larger diameter gear part 64, is formed on the left side surface of the larger diameter gear part 64 of the agitator gear 49. Corresponding to the pressed part 147, a pressed part 148 having the shape of a cylindrical column projects to the right from the right side surface of the toothless gear part 69 of the detected rotational body 50.

Figure 14B:
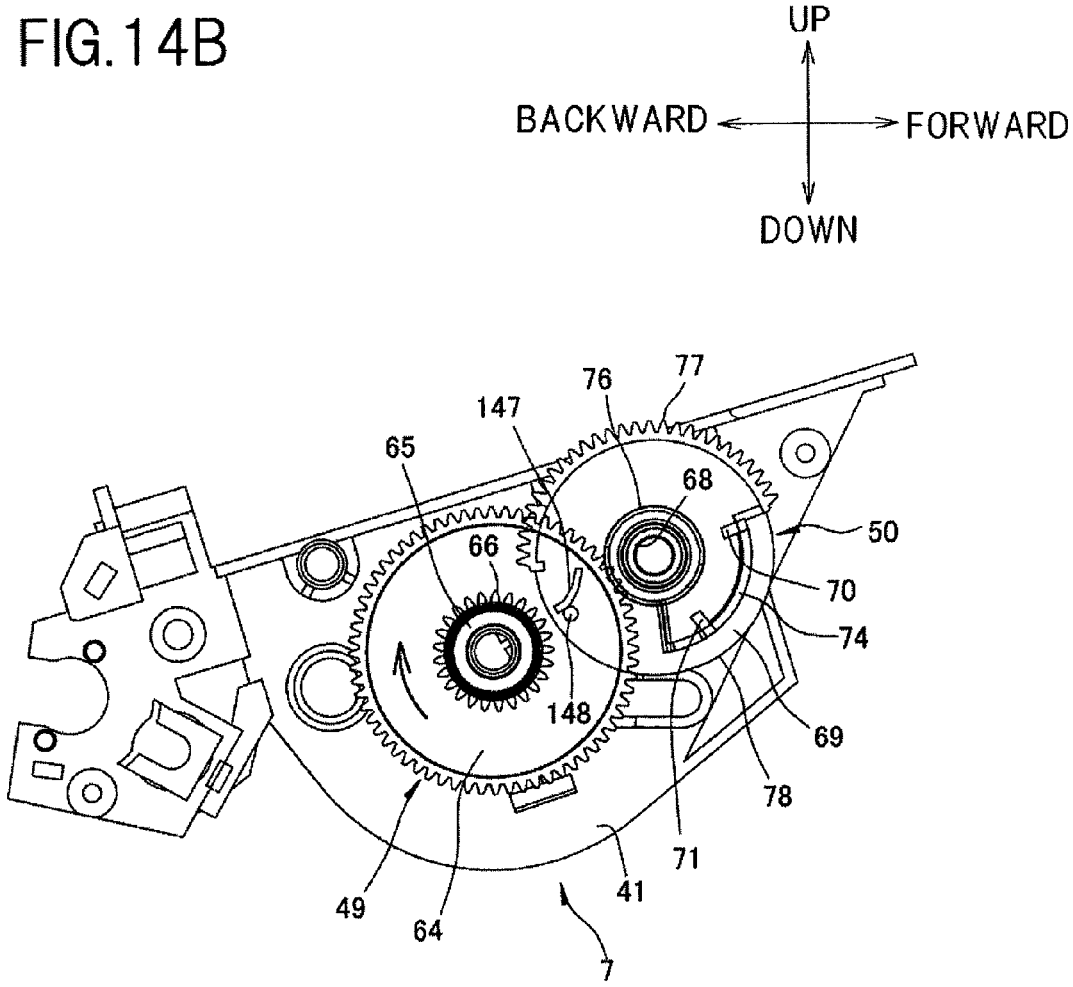
FIG. 14B is a left side view of the developing cartridge shown in FIG. 14A, with the gear cover removed, and with some parts omitted.
Figure 14C:
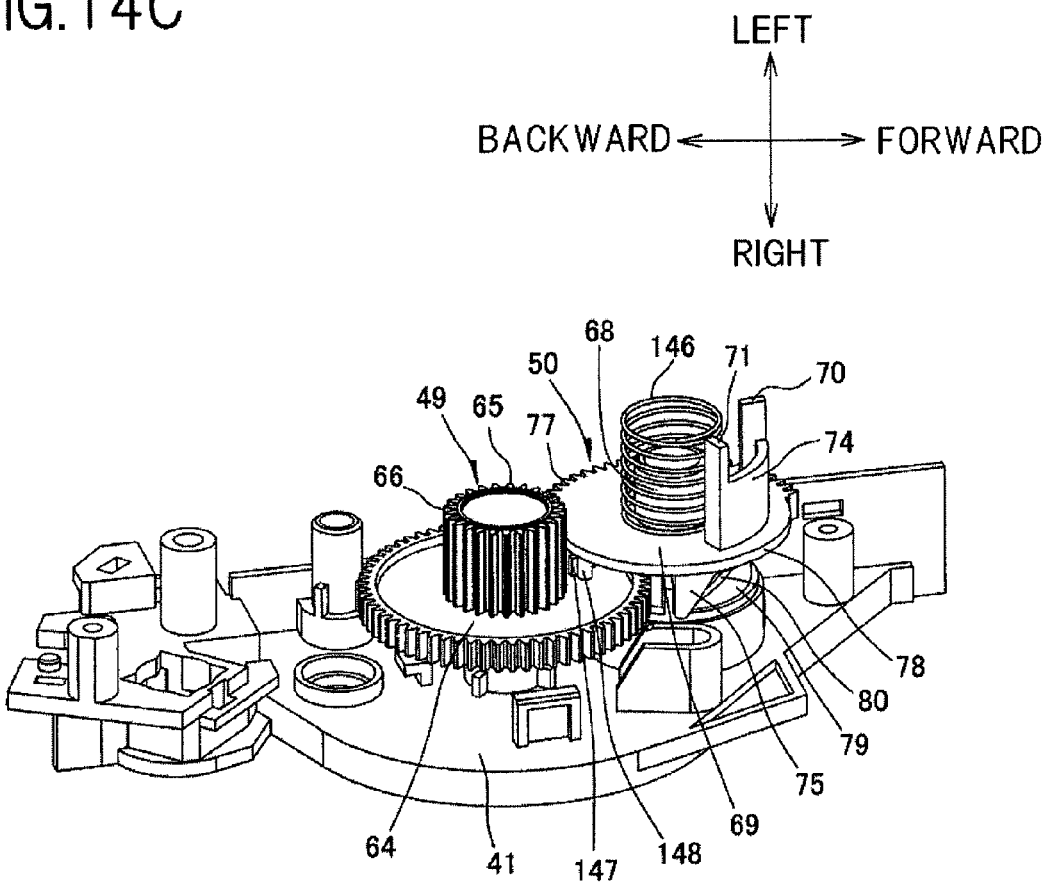
FIG. 14C is a schematic view of the first side wall of the developing cartridge at the position shown in FIG. 14B, from the vantage point of the left-bottom.

As illustrated in FIGS. 14B and 14C, in anew developing cartridge 7, the first and second detected parts 70 and 71 of the detected rotational body 50 are arranged in front of, and front below, the rotation axis 68, respectively. The gear teeth 77 of the detected rotational body 50 is not engaged with the gear teeth 66 of the agitator gear 49 because a lowermost portion of the gear teeth 77 downstream in the rotational direction R is above the agitator gear 49. Further, the supporting part 75 of the detected rotational body 50 is in contact with a portion upstream in the rotational direction R from the inclined surface 80 on the left side surface of the sliding part 79. Moreover, the pressing part 147 of the agitator gear 49 is in contact with the pressed part 148 of the detected rotational body 50 from the upstream of the rotational direction of the agitator gear 49.

The position of the detected rotational body 50 in the right-to-left direction at this moment is an example of the first position as the initial position.

Figure 15A:
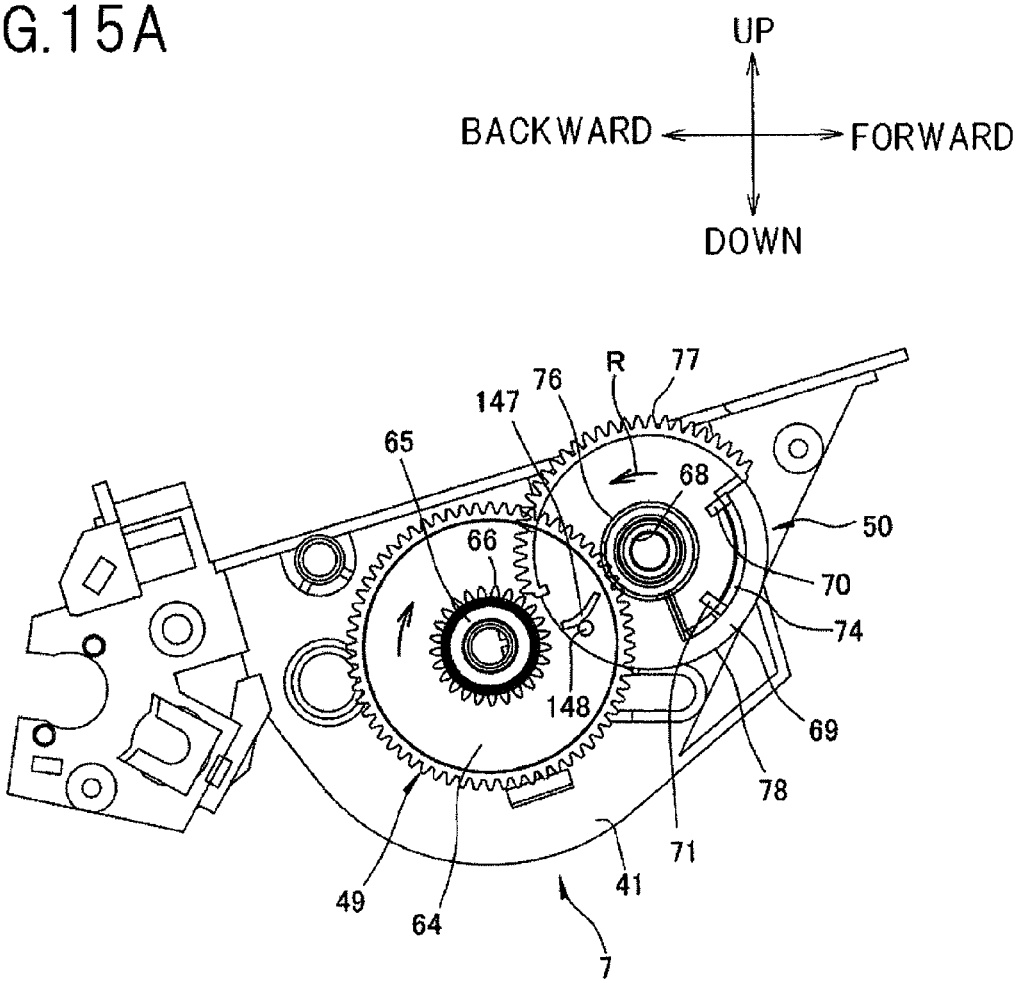
FIG. 15A is a left side view of the developing cartridge shown in FIG. 14B, with the detected rotational body rotated from the position shown in FIG. 14B.
Figure 15B:
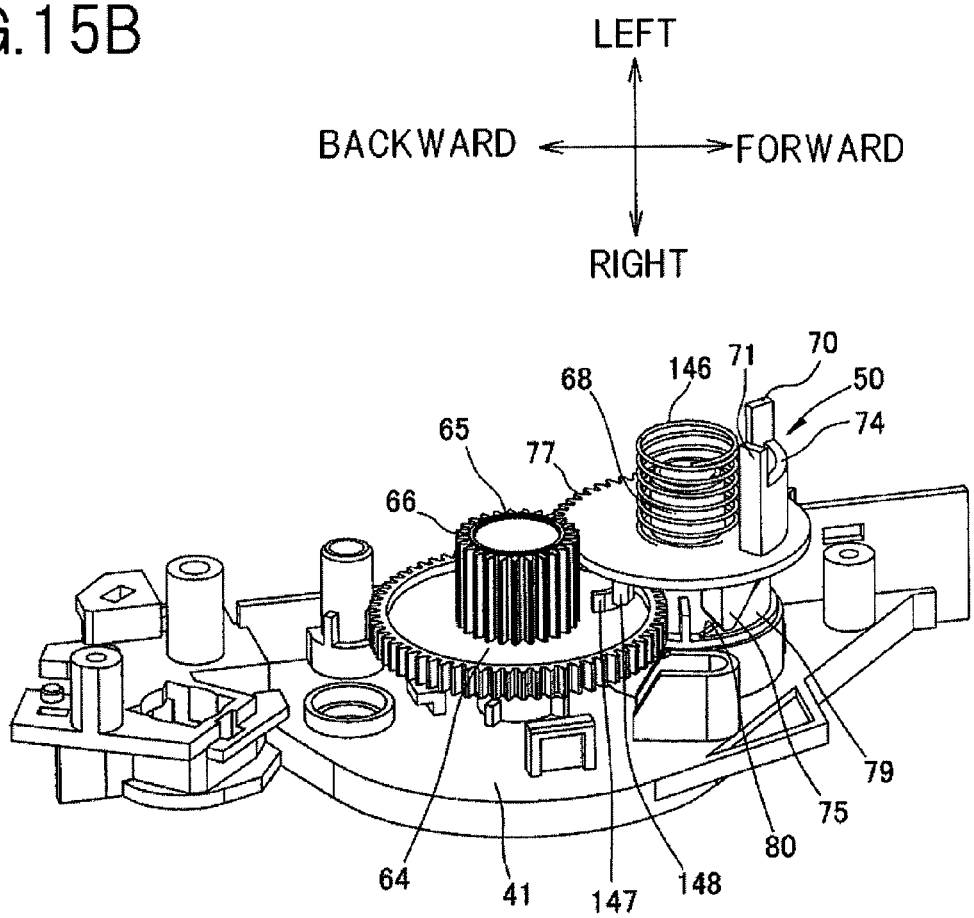
FIG. 15B is a schematic view of the first side wall of the developing cartridge at the position shown in FIG. 15A, from the vantage point of the left-bottom.

When the agitator gear 49 begins to rotate in the course of a warm-up operation of the laser printer 1, the pressing part 147 presses the pressed part 148, and the pressure allows the detected rotational body 50 to rotate in the rotational direction R, as shown in FIGS. 15A and 15B. Accompanying the rotation of the detected rotational body 50, the supporting part 75 of the detected rotational body 50 slides toward the inclined surface 80 on the left end surface of the sliding part 79, and continuously slides toward the parallel surface 81 on the inclined surface 80. As a result, the detected rotational body 50 gradually moves to the left, while so rotating.

When the detected rotational body 50 rotates further, the gear teeth 77 of the detected rotational body 50 is engaged with the gear teeth 66 of the agitator gear 49, as shown in FIG. 16B. Then, the rotation of the agitator gear 49 is transmitted via the gear teeth 66 and 77 to the detected rotational body 50, thereby making the detected rotational body 50 rotate in the rotational direction R.

As the detected rotational body 50 rotates much further, the detected rotational body 50 is arranged at the farthest position leftwards (the second position) when the supporting part 75 of the detected rotational body 50 moves from the inclined surface 80 to the parallel surface 81, as shown in FIG. 16A. Then, the supporting part 75 moves along the parallel surface 81.

When the detected rotational body 50 rotates much further, the supporting part 75 faces, and is fitted to, the notch part 82 (See FIG. 8B). Then, the pressure force of the coil spring 146 allows the detected rotational body 50 to move to the right at a stroke. At the same time, the gear teeth 77 of the detected rotational body 50 is also disengaged with the gear teeth 67 of the agitator gear 49, and then the rotation of the detected rotational body 50 ceases.

Meanwhile, the position in the right-to-left direction of the detected rotational body 50 is an example of the third position.

Alternatively, as the combination of the configurations in modified embodiments 5 and 6, the detected body 102 may be pressed by the coil spring 146.

(7) Modified Embodiment 7

Figure 17:
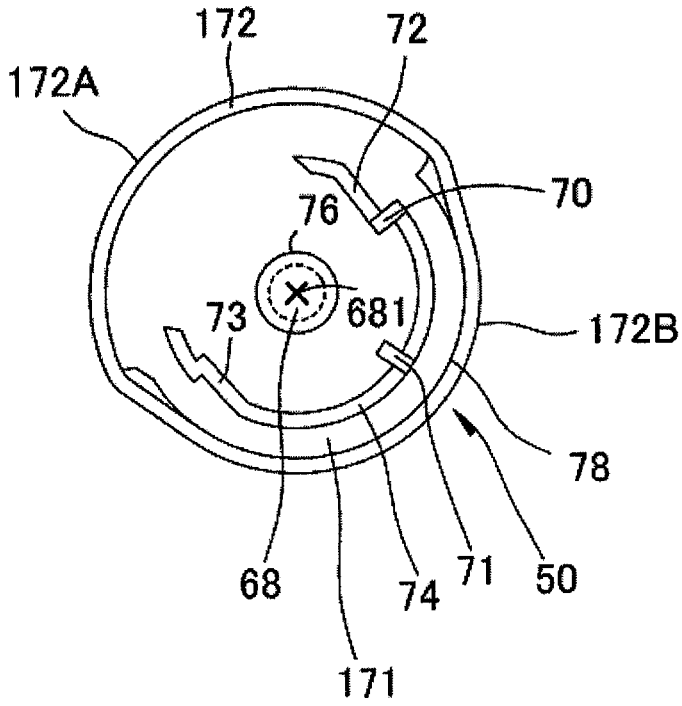
FIG. 17 is a diagrammatic side view of the configuration (modified embodiment 7) replacing the toothless gear part of the detected rotational body.

In the configurations of the embodiment explained above, the detected rotational body 50 includes the toothless gear part 69, and the gear teeth 77 is formed on the circumferential surface of the toothless gear part 69. Instead of the toothless gear part 69, for example, it may be alternatively introduced as illustrated in FIG. 17 that a body 171 is similar to a fan-shaped plate around the rotation axis 68 of the detected rotational body 50, and that a resistance-generating member 172 is made of a material of a higher coefficient of friction such as rubber and is wound around the circumference of the body 171. In this case, the circumferential surface of the smaller diameter gear part 65 of the agitator gear 49 may, or need not, include the gear teeth 67. The body 171 and the resistance-generating member 172 are designed in such a way that a portion 172B having a smaller diameter than the outer diameter of the resistance-generating member 172 is not in contact with the smaller diameter gear part 65, and an arc surface 172A of the member 172 is in contact with the circumferential surface of the smaller diameter gear part 65.

(8) Modified Embodiment 8

Figure 18:
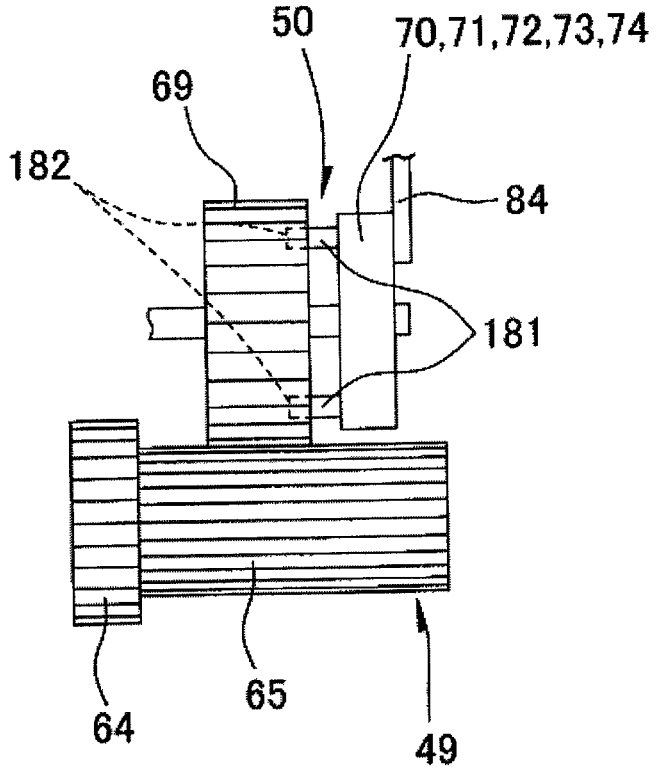
FIG. 18 is a plane view of the configuration (modified embodiment 1) in which the first and second detected parts, the first and second pressed parts, and the connecting parts are formed separately from the toothless gear part.

In the configurations of the embodiment explained above, the detected rotational body 50 includes the first and second detected parts 70 and 71, the first and second pressed parts 72 and 73, and the connecting part 74, all of which project from the left side surface of the toothless gear party 69. Alternatively; as illustrated in FIG. 18, the first and second detected parts 70 and 71, the first and second pressed parts 72 and 73, and the connecting part 74 may all be made as an integral body, while the toothless gear part 69 is separately made from such integral body. The integral body may be coupled with the separate toothless gear part 69 so as not to allow the relative rotation but to allow the rotation as a whole.

In this structure, for example, two bosses 181 are formed in the integral body including the second detected part 71, the first and second pressed parts 72 and 73, and the connecting part 74, and two corresponding recesses 182 are formed in the toothless gear part 69. Then, by fitting each boss 181 to each recess 182, the integral body and the toothless gear party 69 may be connected to rotate at a whole.

(9) Modified Embodiment 9

Figure 19:
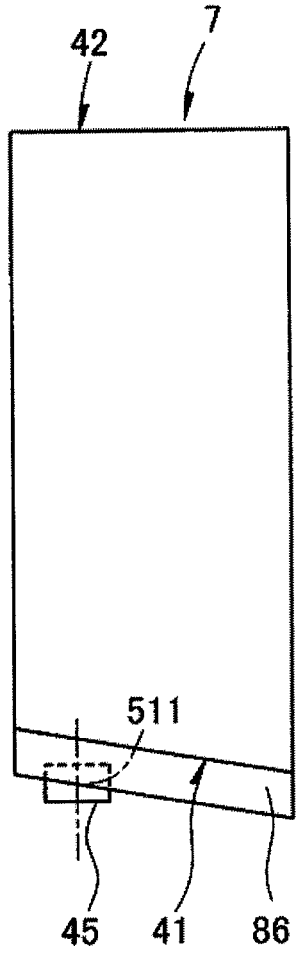
FIG. 19 is a diagrammatic plane view of the developing cartridge to explain another embodiment (modified embodiment 9) mounting the input gear.

In the configurations of the embodiment explained above, the first and second side walls 41 and 42 extend for- and back-wards (in the front-to-back direction). However, as illustrated in FIG. 19, for example, the first side wall 41 may extend in a transverse direction across the front-to-back direction. In this case, the longitudinal direction in which the first and second side walls 41 and 42 face each other may be the right-to-left direction, i.e., the transverse direction crossing the second side wall 42 at a right angle. Further, the input gear 45 may be provided rotatably around the center axis line 511 extending in the right-to-left direction. Alternatively, the longitudinal direction in which the first and second side walls 41 and 42 face each other may be the transverse direction crossing the first side wall 41 at a right angle, and the input gear 45 may be provided rotatably around the center axis line 511 extending in that transverse direction.

(10) Modified Embodiment 10

Figure 20:
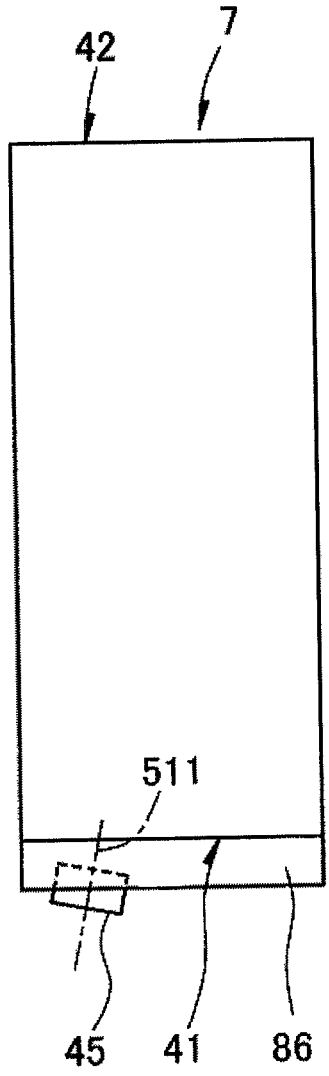
FIG. 20 is a diagrammatic plane view of the developing cartridge to explain the other embodiment (modified embodiment 10) mounting the input gear.

Further, in the configuration where the first and second side walls 41 and 42 extend in the front-to-back direction, the longitudinal direction in which the first and second side walls 41 and 42 face each other is not limited to the right-to-left direction, i.e., the transverse direction crossing the first and second side walls 41 and 42 at a right angle, and may include a direction in which a certain portion of the first side wall 41 faces a certain portion of the second side wall 42. In other words, as illustrated in FIG. 20, the direction facing the first and second side walls 41 and 42 includes an inclined direction with respect to the right-to-left direction, and the input gear 45 may be provided rotatably around the center axis line 511 extending in such an inclined direction.

(11) Modified Embodiment 11

Regarding the embodiment and the modified embodiments, the invention is explained above as an example when it applies to a developing cartridge 7. However, the invention herein is not limited to a developing cartridge 7, and may apply to any cartridge other than a developing cartridge, such as the feature excluding the developing roller 18, i.e., a developer cartridge accommodating only a developer or both a developer and an agitator in a housing.

What is claimed is:

1. A cartridge comprising:

a housing including a first side wall and a second side wall opposed to the first side wall in a longitudinal direction;

a receiving unit configured to receive a driving force from outside, mounted at the housing, and configured to rotate around a first axis line parallel to the longitudinal direction; and a detected body mounted at the first side wall and including a detected part configured to be detected by a detecting unit, wherein the detected body is configured to advance outwards in the longitudinal direction with respect to the first side wall and is configured to retract inwards in the longitudinal direction with respect to the first side wall.

2. The cartridge according to claim 1, further comprising an agitator configured to agitate a developer contained in the housing, wherein the agitator is received by the first and second side walls so as to be rotatable around a second axis line extending parallel to the first axis line, and is configured to be rotated by the driving force received by the receiving unit, wherein the detected body is configured to move in a moving direction parallel to the first axis line, and wherein, the detected body is configured to move from a first position where a distance in the moving direction between the detected body and the first side wall is a first distance, via a second position where the distance in the moving direction between the detected body and the first side wall is a second distance larger than the first distance, to a third position where the distance in the moving direction between the detected body and the first side wall is a third distance smaller than the second distance.

3. The cartridge according to claim 2, wherein the first distance is the same as the third distance.

4. The cartridge according to claim 2, wherein the detected body is rotatably mounted around a third axis line extending parallel to the first axis line, and is configured to move from the first position, via the second position, to the third position, by the rotation in a first direction, wherein the first side wall includes a sliding part on which a contact part of the detected body slides as the detected body moves from the first position to the third position, and wherein one of the contact part and the sliding part includes an inclined surface tilted to be more apart from the first side wall as the inclined surface goes downstream in the first direction.

5. The cartridge according to claim 4, wherein the one of the contact part and the sliding part, including the inclined surface, includes a parallel surface extending continuously from the inclined surface downstream in the first direction and running parallel to the first side wall.

6. The cartridge according to claim 4, further comprising a transmission gear configured to transmit the driving force received by the receiving unit to the detected body, wherein the detected body includes a circumferential surface around the third axis line, wherein a toothless portion is formed on a part of the circumferential surface, and gear teeth is formed on the remaining portion other than the toothless portion of the circumferential surface, and wherein the gear teeth are engaged with the transmission gear while the detected body moves from the first position to the third position.

7. The cartridge according to claim 4, further comprising a pressing member configured to press the detected body to the first side wall.

8. The cartridge according to claim 7, further comprising a boss projecting from the first side wall in the moving direction, wherein the pressing member includes a wire spring coiled around the boss and having one end contact with a side of the detected body opposite to the first side wall.

9. The cartridge according to claim 8, wherein the detected body includes a pressed surface with which the one end of the wire spring is in contact in the first direction when the detected body is in the third position.

10. The cartridge according to claim 7, wherein the first side wall includes a side wall main body and a cover attached to an outer side of the side wall main body in the longitudinal direction to cover the detected body, and wherein the pressing member includes a coil spring interposed between the detected body and the cover and contacting the detected body.

11. The cartridge according to claim 2, further comprising a rotational body provided at the first side wall so as to be rotatable around a third axis line extending parallel to the first axis line, wherein the rotational body is configured to be rotated in a second direction by the driving force received by the receiving unit, wherein the detected body is provided so as to move in a moving direction parallel to the first axis line, and to maintain the position of the detected body around the third axis line, wherein the rotational body includes an inclined surface on which a contact part of the detected body slides while the detected body moves from the first position to the third position, and wherein the inclined surface is tilted so as to be more apart from the first side wall as the inclined surface goes upstream in the second direction.

12. The cartridge according to claim 11, wherein the rotational body includes a parallel surface extending continuously from the inclined surface upstream in the second direction and running parallel to the first side wall.

13. The cartridge according to claim 11, further comprising a transmission gear configured to transmit the driving force received by the receiving unit to the rotational body, wherein a toothless portion is formed on a portion of a circumferential surface around the third axis line, and gear teeth is formed on the remaining portion other than the toothless portion of the circumferential surface, and wherein the gear teeth are engaged with the transmission gear while the detected body moves from the first position to the third position.

14. The cartridge according to claim 11, further comprising a pressing member configured to press the detected body against the first side wall.

15. The cartridge according to claim 14, further comprising a boss projecting from the first side wall in the moving direction, wherein the pressing member includes a wire spring coiled around the boss and having one end contact a side of the detected body opposite to the first side wall.

16. The cartridge according to claim 14, wherein the first side wall includes a side wall main body and a cover attached to an outer side of the side wall main body in the longitudinal direction to cover the detected body, and wherein the pressing member includes a coil spring interposed between the detected body and the cover and contacting the detected body.

17. The cartridge according to claim 2, wherein the first side wall includes a side wall main body and a cover attached to an outer side of the side wall main body in the longitudinal direction to cover the detected body, and wherein the detected body is covered by the cover when the detected body is in the first and third positions, and the detected body is exposed from the cover when the detected body is in the second position.

18. The cartridge according to claim 1, further comprising a developing roller provided between the first and the second side walls so as to be rotatable around a further axis line extending parallel to the first axis line at a distance, and to be rotated by the driving force received by the receiving unit.

* * * * *